US011118767B1

(12) United States Patent
DeCosmo et al.

(10) Patent No.: US 11,118,767 B1
(45) Date of Patent: Sep. 14, 2021

(54) FOLDABLE HOLDER

(71) Applicant: Ulta-Lit Tree Company, Glenview, IL (US)

(72) Inventors: John DeCosmo, Glenview, IL (US); Gregory J. Foster, Chicago, IL (US); John C. Krolopp, Chicago, IL (US)

(73) Assignee: Ulta-Lit Tree Company, Glenview, IL (US)

( * ) Notice: Subject to any disclaimer, the term of this patent is extended or adjusted under 35 U.S.C. 154(b) by 0 days.

(21) Appl. No.: 16/945,357

(22) Filed: Jul. 31, 2020

(51) Int. Cl.
*F21V 21/08* (2006.01)
*F21S 4/10* (2016.01)
*F21V 21/14* (2006.01)

(52) U.S. Cl.
CPC ..... *F21V 21/0816* (2013.01); *F21S 4/10* (2016.01); *F21V 21/08* (2013.01); *F21V 21/14* (2013.01)

(58) Field of Classification Search
CPC ..... F21S 4/10; F21S 4/15; F21S 4/20; F21S 4/22; F21S 4/24; F21S 4/26; F21S 4/28; F21V 21/0816; F21V 23/001; F21V 23/002; F21V 19/00; F21V 19/003; F21V 19/0035; F21V 19/004; F21V 19/0045; F21V 21/08; F21V 21/0832; F21V 21/088; F21V 21/0885; F21V 21/116; F21V 21/12; F21V 21/14; F21V 21/145; F21V 21/26; F21V 21/28; F21V 21/29; F21V 21/34; F21V 17/002; F21V 17/02; F21V 17/04; F21V 17/06; F21V 17/10; F21V 17/107; F21V 17/16; F21V 17/164; F21V 1/06; A45C 2011/003
See application file for complete search history.

(56) References Cited

U.S. PATENT DOCUMENTS 4,901,960 A 2/1990 Gary
4,962,907 A 10/1990 Gary
5,249,108 A * 9/1993 Gary ..... F21V 21/14 248/231.9
5,544,031 A * 8/1996 Blanton ..... F21V 19/007 248/205.1
5,772,166 A * 6/1998 Adams ..... F21V 21/08 248/229.16
6,142,429 A * 11/2000 Ahroni ..... F21V 21/088 248/68.1
2007/0246386 A1* 10/2007 Nykoluk ..... A45C 13/02 206/320
2007/0271865 A1* 11/2007 Rowohlt ..... E04F 19/0436 52/287.1
2008/0230672 A1* 9/2008 Pachowski ..... A47B 23/044 248/453

(Continued)

*Primary Examiner* — Jong-Suk (James) Lee
*Assistant Examiner* — James M Endo
(74) *Attorney, Agent, or Firm* — Nixon Peabody LLP; Justin D. Swindells

(57) ABSTRACT

A holder for setting a bulb in a specified orientation is provided. The holder includes a supporting post, a base including a latch for receiving the supporting post, a flexible portion, a fastener attached to the flexible portion, and a first hinge positioned between the base and the flexible portion. The flexible portion is configured to pivot at the first hinge between (i) a first position where the flexible portion and the base are coplanar and (ii) a second position where the flexible portion and the base are not coplanar and the supporting post is received in the latch.

15 Claims, 18 Drawing Sheets

(56) References Cited

U.S. PATENT DOCUMENTS

| | | | | |
|---|---|---|---|---|
| 2009/0133350 | A1* | 5/2009 | Pritchard | F21V 21/088 52/520 |
| 2010/0090085 | A1* | 4/2010 | Corrion | F16M 11/38 248/459 |
| 2012/0088557 | A1* | 4/2012 | Liang | G06F 1/1628 455/575.1 |
| 2012/0181195 | A1* | 7/2012 | Lu | A45C 11/00 206/320 |
| 2012/0198680 | A1* | 8/2012 | Durben | F16L 3/1218 29/428 |
| 2013/0148366 | A1* | 6/2013 | Adams, IV | F21V 21/088 362/396 |
| 2015/0359328 | A1* | 12/2015 | van Hooft | F16B 1/00 248/456 |
| 2018/0017240 | A1* | 1/2018 | Schreiber | F21V 21/088 |

* cited by examiner

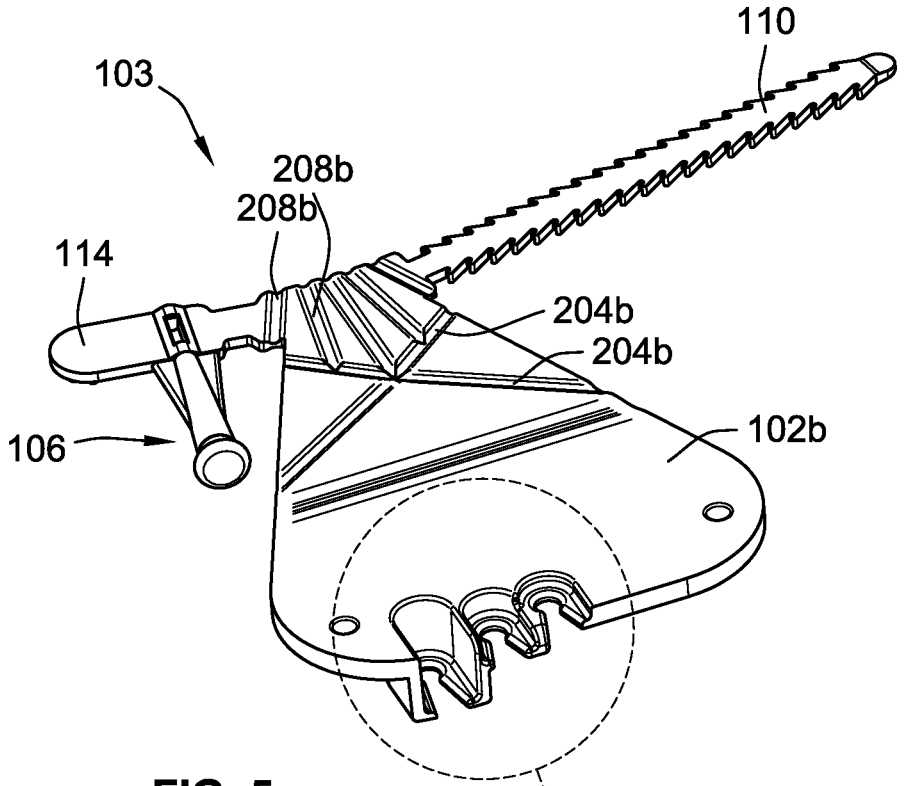
FIG. 5
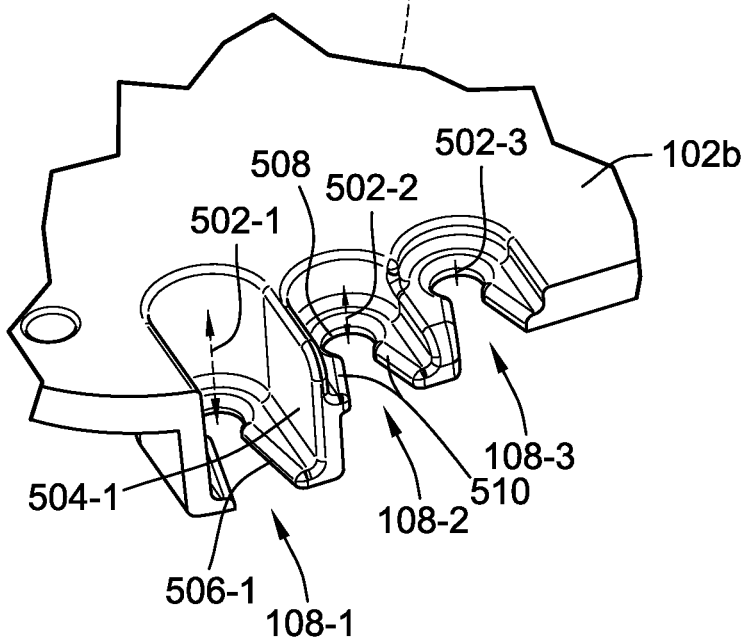

FOLDABLE HOLDER

TECHNICAL FIELD

The present disclosure relates generally to design of mechanical holders, and more specifically, to an apparatus for holding or supporting items in a direction orthogonal to a base of the apparatus. An aspect of the present disclosure specifically relates to an adaptable light holder that can be configured to receive light bulbs having sockets of different diameters.

BACKGROUND

Decorative lights include holiday lights and icicle lights which are sometimes known as fairy lights or string lights because individual bulbs in the light string are strung together, sharing electrical wires that provide power to the bulbs. Energy efficiency is desirable for decorative lights since multiple bulbs in close proximity are expected to be lit at once. Decorative lights that use too much power can generate excess heat or can require connection to multiple power outlets. As decorative lights become more energy efficient and generate negligible heat, a selection of materials that can be used for decorative light holders expands. For example, certain plastics that were once undesirable for high-wattage bulbs due to risk of melting can, with the advent of lower-wattage bulbs like LED bulbs, be considered as suitable materials for holders due to the reduction in heat generated by decorative lights. Decorative lights, when used, are more impactful visually in numbers, hence decorative lights usually include individual bulbs that are strung together (e.g., up to 35, or 50, or 100 or 140 (4 sets of 35) bulbs per string). Advantages to stringing individual bulbs together are that power outlets can be shared with multiple bulbs in a string, and spacing between the bulbs is predefined. One disadvantage of decorative lights in a string is a difficulty in positioning or orienting direction of each bulb in the string, especially because the source and return wires interconnecting each light bulb ordinarily cause each bulb to be oriented haphazardly and randomly along the string when unfurled. Moreover, bulbs can have sockets of different diameters, and conventional bulb holders are often suited for one particular diameter, and different bulb holders must be used to secure different socket diameters. Other holders have complex geometries, multiple parts, do not lie flat in their pre-assembled configuration, and cannot be packaged in a space-efficient manner. Still other holders do not offer flexibility of installation while orienting the bulbs in a desired direction relative to a structure or structures (tree, a house, wall, ceiling, fence, etc.) to which the light string is mounted. Some bulb holders fail at securing the bulb's socket into a fixed orientation, allowing the bulb to sag or tip over slightly under tension from or slight tugging at the light string wires, requiring the user to go back and try to re-orient the shifted bulbs. The present disclosure is directed at solving these and other problems.

SUMMARY

According to some implementations of the present disclosure, a holder for setting a bulb in a specified orientation is provided. The holder includes a supporting post, a base including a latch for receiving the supporting post, a flexible portion, a fastener attached to the flexible portion, and a first hinge positioned between the base and the flexible portion. The flexible portion is configured to pivot at the first hinge between (i) a first position where the flexible portion and the base are coplanar and (ii) a second position where the flexible portion and the base are not coplanar and the supporting post is received in the latch.

According to some implementations of the present disclosure, a method for configuring a holder for setting an object in a specified direction is provided. The holder is constructed from a single substrate. The method includes pivoting a flexible portion of the holder around a first hinge from a first position, where the flexible portion of the holder and a base of the holder are coplanar, to a second position, where the flexible portion of the holder and the base of the holder are not coplanar. A supporting post of the holder is latched to the base of the holder. The supporting post is latchable to the base when the flexible portion of the holder is at the second position. The object is fastened to the flexible portion of the holder using a fastener attached to the flexible portion of the holder.

According to some implementations of the present disclosure, a holder configured to hold a bulb in a fixed position relative to the holder is provided. The holder includes a base portion and a flexible portion being coplanar in a flat configuration. The holder further includes a first score or crease on a first surface between the flat portion and the flexible portion. The holder further includes a second score or crease on a second surface opposite the first surface on the flexible portion. The holder further includes a strip extending from the foldable portion and having a free end. The flexible portion is non-coplanar with the base portion in a non-flat configuration in which the flexible portion is folded in a first direction relative to the base portion at the first score and in a second direction different from the first direction at the second score.

According to some implementations of the present disclosure, a holder is provided. The holder includes a base portion having a slot; a top portion; an intermediate portion between the base portion and the top portion and having multiple folding sections to form a support for the top portion; a strap portion extending from the top portion and having a free end; and a post extending from the top portion and configured to lock into the slot to form an opening between the base and top portion.

According to some implementations of the present disclosure, a holder is provided. The holder includes a base portion; a top portion; an intermediate portion between the base portion and the top portion and having a score or crease between the intermediate portion and the base portion; and an elongated strap portion having a free end and extending from the top portion along an angle that deviates from the score or crease by about 20 degrees.

According to some implementations of the present disclosure, a system is provided. The system includes a light string and a holder. The holder includes a base portion; a top portion; an intermediate portion between the base portion and the top portion and having a score or crease between the intermediate portion and the base portion; and an elongated strap portion having a free end and extending from the top portion along an angle that deviates from the score.

The above summary is not intended to represent each implementation or every aspect of the present disclosure. Additional features and benefits of the present disclosure are apparent from the detailed description and figures set forth below.

BRIEF DESCRIPTION OF THE DRAWINGS

FIG. 5 illustrates a perspective view of a latch on the holder of FIG. 2, according to some implementations of the present disclosure.

Figure 1A:
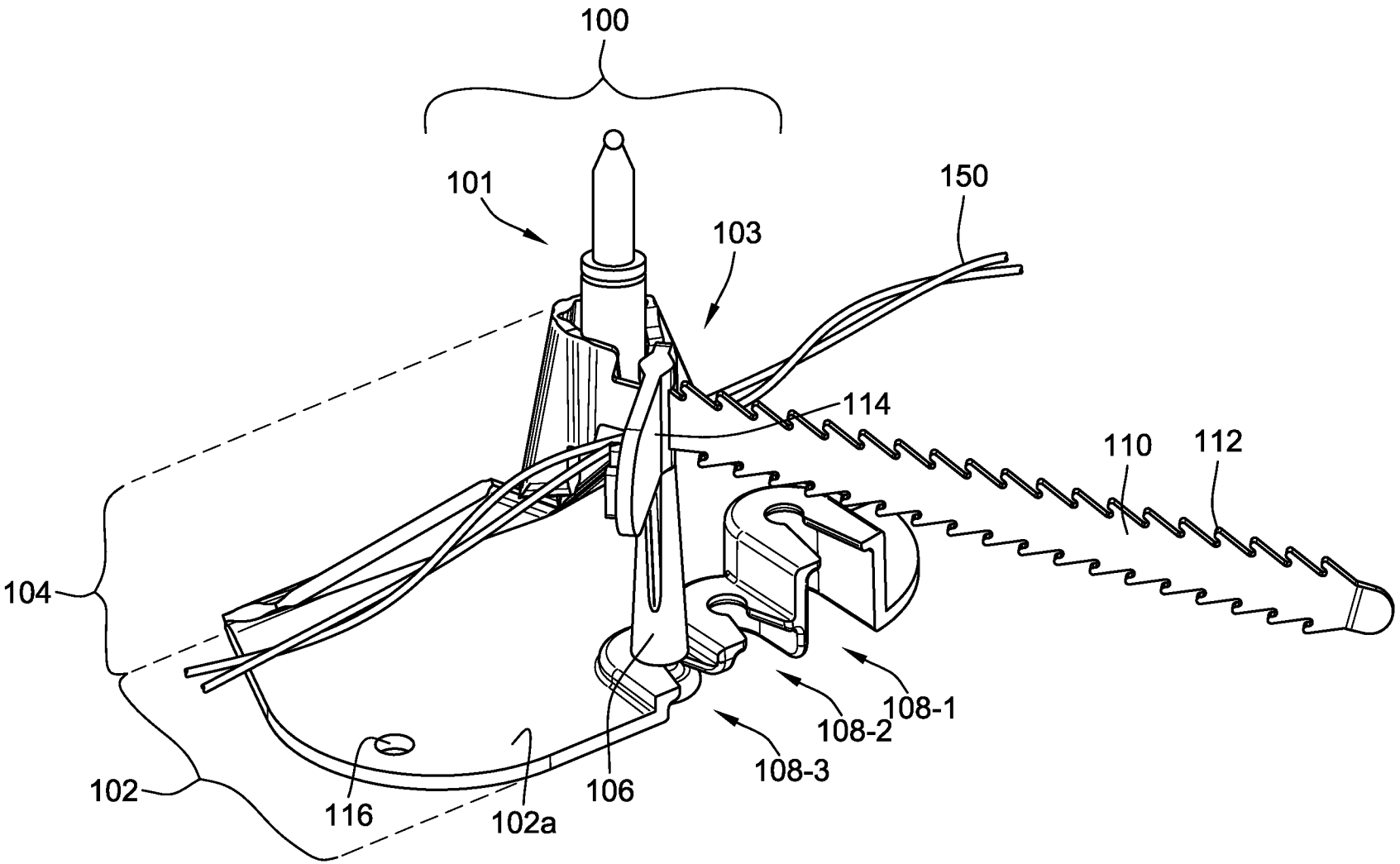
FIG. 1A illustrates a front perspective view of a bulb in a holder, according to some implementations of the present disclosure.

While the present disclosure is susceptible to various modifications and alternative forms, specific implementations and embodiments thereof have been shown by way of example in the drawings and will herein be described in detail. It should be understood, however, that it is not intended to limit the present disclosure to the particular forms disclosed, but on the contrary, the present disclosure is to cover all modifications, equivalents, and alternatives falling within the spirit and scope of the present disclosure as defined by the appended claims.

DETAILED DESCRIPTION

The present inventions can be embodied in many different forms. Representative embodiments are shown in the drawings, and will herein be described in detail. The present disclosure is an example or illustration of the principles of the present disclosure, and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference, or otherwise. For purposes of the present detailed description, unless specifically disclaimed, the singular includes the plural and vice versa; and the word "including" means "including without limitation." Moreover, words of approximation, such as "about," "almost," "substantially," "approximately," and the like, can be used herein to mean "at, near, or nearly at," or "within 3-5% of," or "within acceptable manufacturing tolerances," or any logical combination thereof, for example.

Icicle lights, holiday lights, and other decorative lights are usually strung together for decorative or ornamental purposes. When these lights are taken out of the box for use, each light bulb rests in a position dictated by electrical wires that power the light bulbs. The nature of copper and polyvinyl chloride (PVC) materials used for the electrical wires and corresponding insulation of the light bulbs cause a randomness and unruly nature when trying to organize the light bulbs to appear in a unified or orderly fashion. That is, dictating a specific orientation of a light bulb in a string of decorative lights is a difficult proposition without additional tools or a chosen arrangement that fixes each bulb in a desired orientation. A light string herein refers to one or more strings of light bulbs (of any illuminating type, including incandescent and LED), wired together by one or more electrical wires to carry electrical power between a power source and each light bulb on the string or strings. A light bulb includes a socket or base that holds the light emitting element in a fixed position relative to one of the wires. While the socket or base is not necessary for the functioning of the bulb, they provide a uniform structure for each light emitting element (or "bulb") so that the light emission does not occur in close proximity to the wires, which could interfere with the visual effect. A bulb or light emitting element refers to herein as any light emitting structure, such as a filament or LED, contained within an optically transparent or semi-transparent housing, which may be clear, frosted, or colored but nevertheless permits emission of "artificial" light from the light emitting structure through the housing. The light emitting structure sits on a base or socket, which in turn is electrically coupled to one or more wires comprising the light string. Artificial light refers to a light source that is illuminated by a non-flammable power source, such as from an electrical battery or wall outlet.

Some holiday or icicle lights used for decorative or ornamental purposes (e.g., those used for holiday decorating) are well known to resemble candle-like flames. A lit wax candle in the traditional sense is never oriented upside-down, and usually during use, a lit candle's flame burns from a candle wick oriented perpendicular to a base of the candle. The base of the candle is usually situated on a flat surface so that melted candle wax can collect around the flame and excess melted wax can drip down the side of the lit candle.

A conventionally lit candle in this orientation thus produces an upright candle flame. Although design of artificial holiday and icicle lights is inspired by the upright candle flame, artificial lights are rarely positioned upright because orientation of each bulb is dictated by gravity and the electrical wires that power the bulbs. Some implementations of the present disclosure provide a holder that can be used to position an artificial light bulb upright. Some implementations of the present disclosure provide a holder that can be used to position an artificial light bulb in an orientation perpendicular to a surface of the base or socket of the holder.

Holders designed according to some implementations of the present disclosure have several advantages, some of which are mentioned here. For example, a holder can be produced using a one-step process manufacturing step. A holder can be shipped in a flattened shipping configuration where multiple holders can be stacked on top of each other to conserve space in a shipping package. That way, twenty, thirty, forty, fifty, seventy, one hundred, etc., holders can be packaged and shipped together while taking up the minimum amount of space without much unused air volume between adjacent holders. A holder can be designed to be thin to reduce cost of material used in manufacturing the holder. Holders designed according to some implementations of the present disclosure can be provided to consumers at a much lower price because manufacturing, packaging, and shipping costs can be reduced. They can accommodate many different base or socket diameters, so the same holder can be used on a relatively small diameter bulb socket as well as on a relatively large diameter bulb socket. The holders herein can be assembled very quickly, without any tools, and can be reversed just as quickly, also without any tools. The holders lie flat in their uninstalled configuration, reducing space requirements. As discussed herein, the holders in some embodiments can be erected using an origami-inspired folding action that converts the flat holder into an upright holder that secures the socket while also allowing the wires to run along unimpeded to the next bulb. Regardless of the bulb diameter, the holder always allows the bulb to stay in a fixed, upright orientation relative to the wires, without tilting or sagging during or after installation of all of the bulb sockets of the light string into respective holders, even without any adhesive or other securing mechanism, though temporary or permanent adhesives or securing structures can be used to secure the holders to a structure such as a tree, indoor or outdoor structure of a house including a wall, ceiling, gutter, frame, baseboard, or roof, a fence, a post, a lawn, and the like. The visual effect of installing the holders of the present disclosure to secure the bulb sockets of a light string is that every light bulb will be consistently oriented in the same direction, creating a very tidy, organized, and uniform look as the bulbs are illuminated. For a given light string, different subsets of light bulbs can be oriented in different directions using the holders of the present disclosure, such as when a frame transitions to a ceiling, allowing those bulbs on the frame to be oriented, e.g., parallel to the floor, while other bulbs along the ceiling to be oriented perpendicular to the bulb orientation along the frame, all along the same light string each being secured using the same type of holder. Moreover, the holders can be uninstalled just as easily, making the uninstallation process a breeze. The used holders can be saved and reused such as for a light string having different bulb diameters in a subsequent installation, and any damaged or disfigured holders (e.g., due to weather or other external factors) can be replaced by the same holder without regard for the bulb diameter. For example, one season, an installer could use a light string having a small diameter bulb socket using the holders of the present disclosure. In a subsequent season, the installer could re-use the same holders to secure a light string having a large diameter bulb socket, without having to use a different set of holders. By way of another example, an installer can use the same holders to install light strings comprising light bulb sockets having two or more different diameters.

Referring to FIG. 1A, a front perspective view of a bulb-holder combination or assembly 100 is provided, according to some implementations of the present disclosure. The bulb-holder combination or assembly 100 includes a bulb 101 and a holder 103. The holder 103 includes an upright or an elevated or intermediate/top section or portion 104 and a base or base portion 102. The holder 103 is configured to orient the bulb 101 such that the bulb 101 is at a fixed angle, such as perpendicular or orthogonal, to the base or socket 102 of the holder 103. As used herein, a "portion" of an apparatus or device herein can refer to a section or area of a part or structure of an integral one-piece apparatus or device. In some implementations, the holder 103 is a single, unitary piece having different portions described herein. Alternately, the holder 103 can be composed of multiple parts, which can be joined or formed together to form the holder 103.

The elevated section 104 is configured to clasp or hold the bulb 101 in place such that the bulb 101 remains in a specified or fixed orientation in relation to the base 102 of the holder 103. The elevated section 104 includes a fastener for clasping the bulb 101 in place. In some implementations, the fastener is a zip tie including a strap or a strip 110 and a keeper 114. The strip 110 engages the keeper 114, and the keeper 114 is configured to hold the strip 110 in place. In some implementations, the strip 110 includes several teeth or other holding structures 112 that facilitate the keeper 114 holding the strip 110 in place.

The elevated section 104 can further include a supporting post 106. The supporting post 106, when latched to the base 102, restricts lateral and perpendicular motion of the clasped bulb. The supporting post 106, when latched to the base 102, defines a height at which the strip 110 and the keeper 114 are located relative to the base 102. The supporting post 106, when latched to the base 102, determines a curvature for the exposed circumferential top of the keeper 114.

The base 102 can include a latch for receiving the supporting post 110. In some implementations, the latch includes a series of individual openings or notches 108-1, 108-2, 108-3, etc., alongside the base 102. Each of the individual openings or notches 108-1, 108-2, 108-3, etc., defines a discrete height such that the supporting post 106 is positioned closer to a top base surface 102*a* when latched at the individual opening or notch 108-3 and positioned farther from the top base surface 102*a* when latched at the individual opening or notch 108-1. In some implementations, when the supporting post 106 is latched to the base 102 via one of the notches 108-X, the supporting post 106 is positioned orthogonal to the base 102. In this manner, socket sizes of different diameters can be secured by the fastener 110, 114 and held in the same fixed orientation relative to the base portion 102, and regardless of the bulb diameter, the exposed circumferential top of the keeper 114 has a generally flush or flat profile to keep the bulb 101 in a fixed orientation relative to the base portion 102.

Figure 1B:
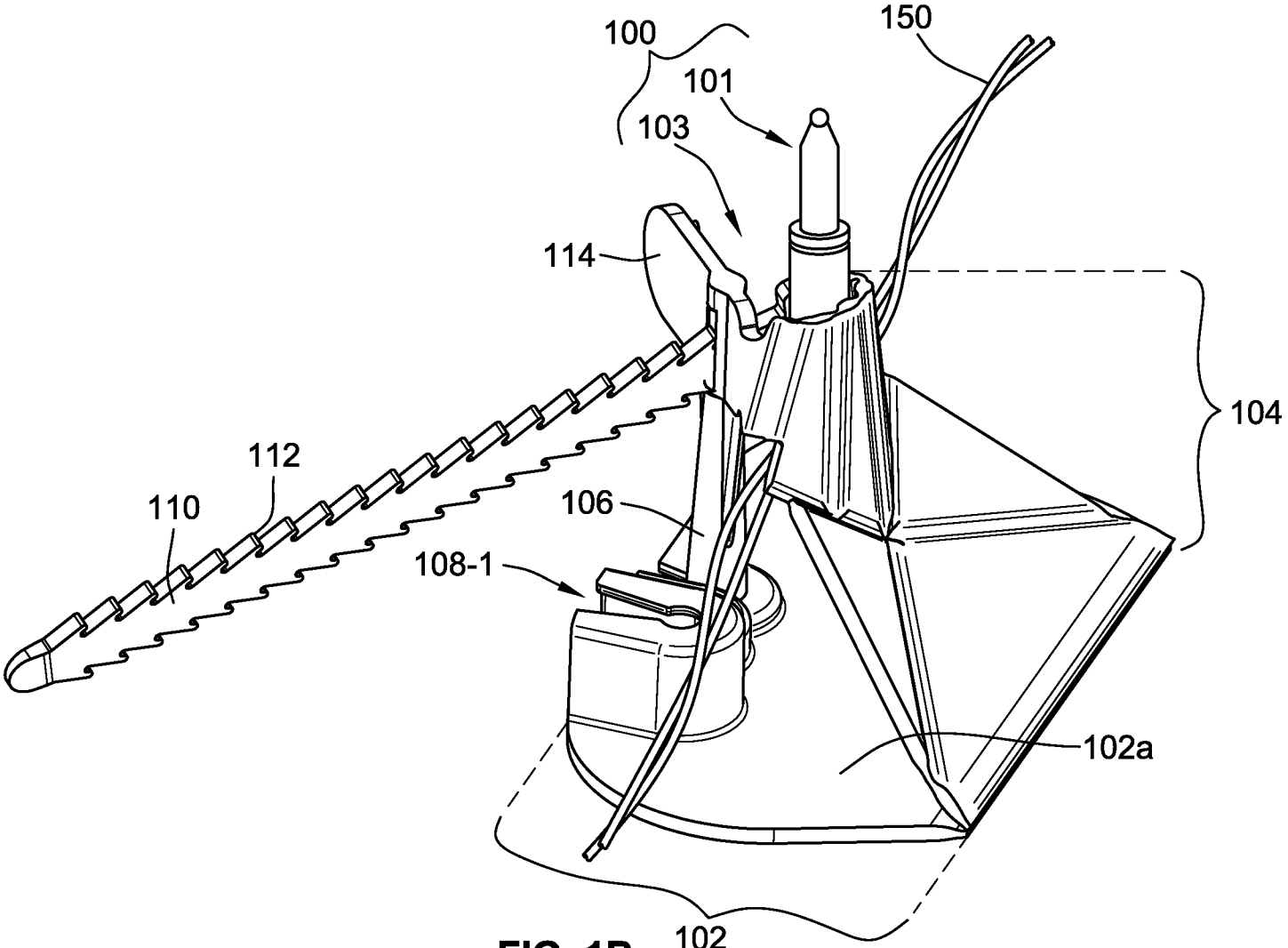
FIG. 1B illustrates a back perspective view of the bulb in the holder of FIG. 1A.

The base 102 provides stability for the bulb-holder combination 100 such that the bulb-holder combination 100 does not tip over or sway and can remain stationary on a surface. The base 102 of the holder 103 can include one or more holes 116 that facilitate securing the holder 103 to the surface. The one or more holes 116 can receive nails, screws, staples, etc., used for securing the holder 103 to the surface. By providing the one or more holes 116, the surface need not be a horizontal surface. That is, the surface can be a vertical surface or an inclined surface. The base 102 can be secured or adhered by an adhesive, temporary (e.g., using 3M's COMMAND strips, or permanent, to any surface (vertical, horizontal, curved, or slanted, or stepped, to name a few examples), while the holder 103 maintains the bulb 101 orthogonal or at another fixed angle relative to the base 102. With such a configuration, the bulb 101 can be positioned orthogonal or at a fixed angle relative to a vertical wall in some implementations such that wires 150 of the bulb 101 are closer to the vertical wall compared to a top of the bub 101. The bulb 101 can be positioned orthogonal to the floor or ground in some implementations such that the wires 150 of the bulb 101 are closer to the ground. The bulb 101 can be positioned orthogonal to a ceiling in some implementations such that the wires 150 of the bulb 101 are closer to the ceiling. The bulb 101 can be positioned orthogonal to an inclined surface in some implementations such that the wires 150 of the bulb 101 are closer to the inclined surface. FIG. 1B illustrates a back perspective view of the bulb-holder combination 100 of FIG. 1A.

Figure 2:
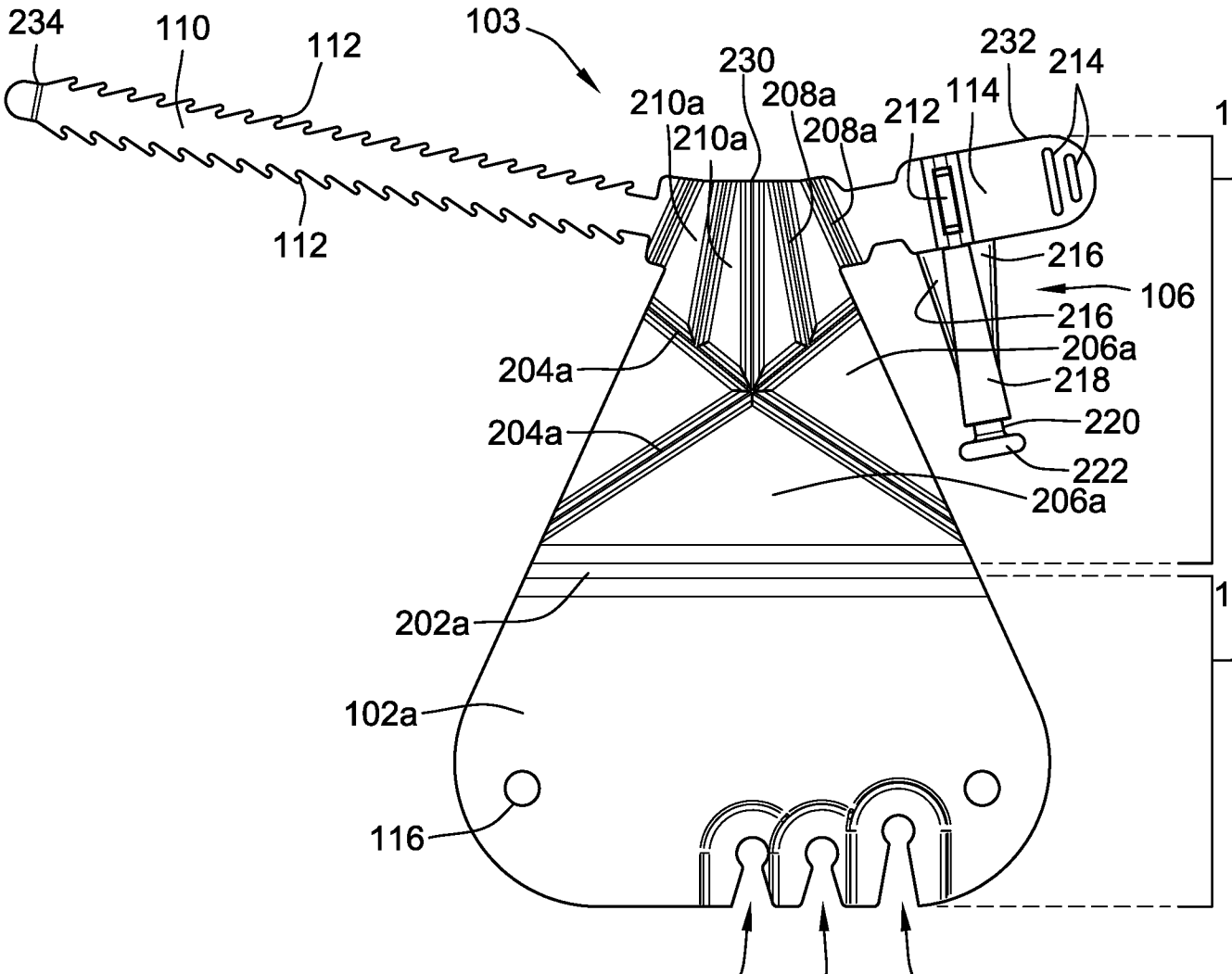
FIG. 2 illustrates a top plan view of a holder in a first configuration, according to some implementations of the present disclosure.
Figure 3:
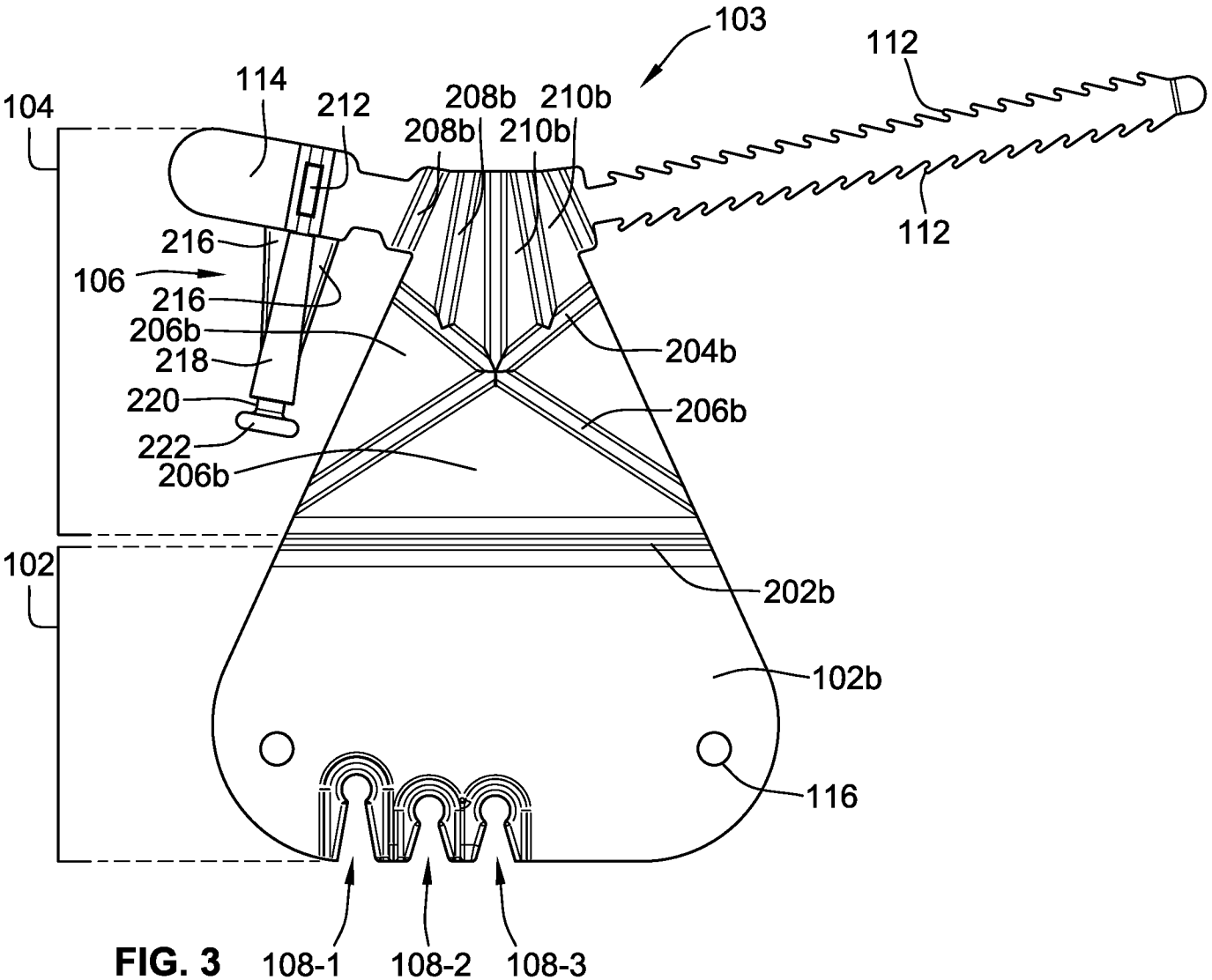
FIG. 3 illustrates a bottom plan view of the holder of FIG. 2, according to some implementations of the present disclosure.

The holder 103 of FIGS. 1A and 1B can be provided in different configurations. FIGS. 1A and 1B illustrated the holder 103 in an assembled position (or an assembled configuration) for holding the bulb 101. The bulb 101 is secured in the holder 103, and the holder 103 includes a channel between the elevated section 104 and the base 102 for routing the wires 150 of the bulb 101. In contrast, FIG. 2 illustrates a top plan view of the holder 103 in a shipping position (or a shipping configuration or an unassembled configuration), according to some implementations of the present disclosure. "Top" plan view as used here is merely to distinguish between different surfaces of the holder 103. For example, FIG. 3 illustrates a bottom plan view of the holder 103, according to some implementations of the present disclosure. FIG. 3 illustrates the holder 103 of FIG. 2 flipped over such that the "bottom" surface of the holder 103 is visible and the "top" surface of the holder 103 is hidden. To aid in distinguishing between the "top" surface (FIG. 2) and the "bottom" surface (FIG. 3), indicators "a" and "b" are appended to reference numbers (e.g., 202*a* in FIGS. 2 and 202*b* in FIG. 3).

Figure 4:
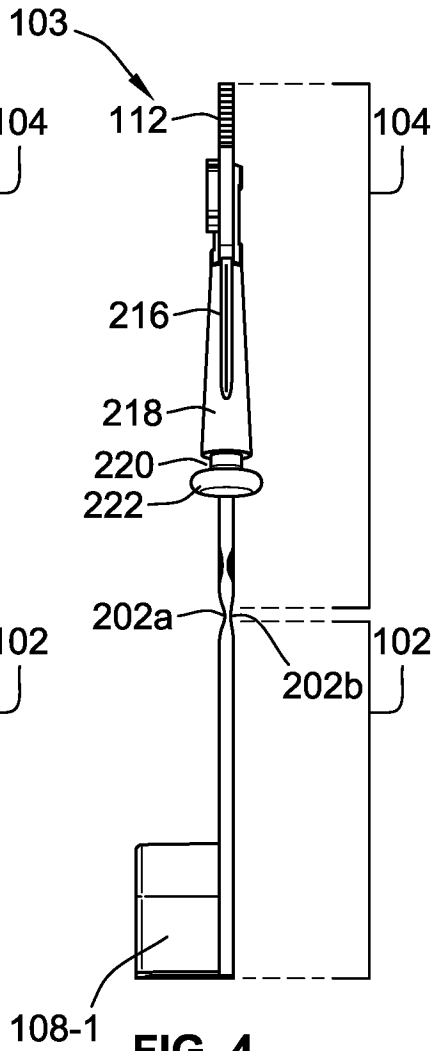
FIG. 4 illustrates a side view of the holder of FIG. 2, according to some implementations of the present disclosure.

Referring to FIG. 2, the holder 103 is provided in the unassembled or shipping configuration. In the unassembled configuration, the holder 103 is mostly planar or lies essentially flat. An overall thickness dimension of the holder in the unassembled or shipping configuration is no greater than the height of the notches 108 (best seen in FIG. 4). FIG. 4 illustrates a side view of the holder 103 in the unassembled configuration, showing the planar nature of the holder 103. The elevated section 104 and the base 102 are thus coplanar. In FIG. 4, parts of the holder 103 that are not flat and span multiple planes are the supporting post 106 and portions of the latch that contains the individual notches 108-X. Referring back to FIG. 2, parts of the fastener (i.e., the keeper 114 and the strip 110) can have elongated form factors. The strap or strip 110 extends from a first side of the elevated section 104, and the keeper 114 extends from a second side (opposite the first side) of the elevated section 104. A major axis of the strip 110 extends at an angle from the first side of the elevated section 104, and a major axis of the keeper 114 extends at an angle from the second side of the elevated section 104.

In some implementations, the strip 110 extends at the angle from the first side of the elevated section 104 such that at least a portion 234 of the strip 110 extends above an upper edge 230 of the elevated section 104. In some implementations, the keeper 114 extends at the angle from the second side of the elevated section 104 such that at least a portion 232 of the keeper 114 extends above the upper edge 230 of the elevated section 104. In some implementations, if the major axis of the strip 110 and the major axis of the keeper 114 are extended, both major axes will intersect at an angle less than 180 degrees. That is, when viewing the holder 103 of FIG. 2, a straight line drawn along the upper edge 230 will intersect the keeper 114 and the strip 110, thus indicating that both the strip 110 and the keeper 114 extend above the upper edge 230. Furthermore, in some implementations, no straight line can be drawn that encompasses all of both the keeper 114 and the strip 110 due to the major axes for both the keeper 114 and the strip 110 not being parallel to each other.

The keeper 114 can include one or more bumps or protrusions 214. The protrusions 214 can be shaped as parallel lines, a single line, a circle, a square, etc. That is, a "top" surface (viewed in the plane of the holder 103 shown in FIG. 2) of the keeper 114 can be embossed with any type of design. The keeper 114 can include a spacing 212 or opening. The spacing 212 can receive the strip 110 such that the several teeth 112 prevent the strip 110 from disengaging from the keeper 114. The protrusions 214 can facilitate threading the strip 110 through the spacing 212 of the keeper 114 by providing an unsmooth surface on the keeper 114. The unsmooth surface can prevent a finger of an individual assembling the holder 103 from slipping from the keeper 114 while the individual is threading the strip 110 through the spacing 212 of the keeper 114 to secure the item (e.g., the bulb 101 of FIG. 1A).

The holder 103 includes a hinge 202*a*, 202*b* having a top hinge surface 202*a* and a bottom hinge surface 202*b* (FIG. 3, 4). The hinge 202*a*, 202*b* separates the elevated section 104 from the base 102. The holder 103 pivots at the hinge 202*a*, 202*b* to facilitate configuring the holder 103 in the assembled configuration of FIGS. 1A and 1B. In some implementations, the hinge 202*a*, 202*b* includes scores or creases provided on the top surface (surface "a" of FIG. 2) of a substrate, the bottom surface (surface "b" of FIG. 3, which is opposite surface "a") of the substrate, or both the top surface and the bottom surface of the substrate. If scores are provided on both the top surface and the bottom surface of the substrate, a depth of the score on the top surface can be greater than, less than, or the same as a depth of the score on the bottom surface. Each of the scores can have a v-shaped cross-section to facilitate a folding direction of the sections or portions adjacent the corresponding score.

In some implementations, the holder 103 includes one or more indentations. The indentations can be a first type of indentations 204*a*, 204*b* (FIGS. 2, 3) and/or a second type of indentations 208*a*, 208*b* (FIGS. 2,3). The first type of indentations 204*a*, 204*b* are coarse and run from one edge of the elevated section 104 to another edge of the elevated section 104. The first type of indentations 204*a*, 204*b* divides the elevated section 104 into multiple sections 206*a*, 206*b*. In some implementations, the first type of indentations 204*a*, 204*b* divides the elevated section 104 into three sections 206*a*, 206*b* as shown in FIGS. 2 and 3. Three sections are merely provided as an example. In some implementations, the multiple sections 206*a*, 206*b* are greater than three (e.g., four, five, six, etc.). In some implementations, the multiple sections 206*a*, 206*b* are less than three (e.g., two and one). In some implementations, the multiple sections 206*a*, 206*b* are multiple flat sections.

The second type of indentations 208*a*, 208*b* can be shorter than the first type of indentations 204*a*, 204*b*. The second type of indentations 208*a*, 208*b* divides a portion of the elevated section 104 into multiple sections 210*a*, 210*b* (FIGS. 2, 3). The multiple sections 210*a*, 210*b* can have a smaller area compared to the multiple sections 206*a*, 206*b*. In some implementations, the multiple sections 210*a*, 210*b* are four sections, and in other implementations, the multiple sections 210*a*, 210*b* are more or less than four sections. As the number of the multiple sections 206*a*, 206*b*, 210*a*, 210*b* increases, the more foldable the elevated section 104 becomes. In some implementations, the multiple sections 210*a*, 210*b* are multiple flat sections. Taking into account the hinge 202*a*, 202*b*, the first type of indentations 204*a*, 204*b*, and the second type of indentations 208*a*, 208*b*, the holder 103 can be described as having three portions—a base portion identified by the base 102, an intermediate portion identified by the multiple sections 206*a*, 206*b*, and a top portion identified by the multiple sections 210*a*, 210*b*.

The indentations 204*a*, 204*b*, 208*a*, 208*b* facilitate bending or folding the elevated section 104 such that the elevated section 104 can partially conform to a shape of an item (e.g., the bulb 101 in FIG. 1A) being held by the holder 103. In some implementations, folding or bending at the indentations 208*a*, 208*b* can create "chimney" or funnel-like passageway using the multiple sections 210*a*, 210*b* for holding the item (e.g., see part of the elevated section 104 resembling a chimney and surrounding the bulb 101 in FIGS. 1A and 1B). In some implementations, the chimney can hold a bulb with a minimum diameter of 2.4 mm and a maximum diameter of 7.7 mm.

The chimney created by the folding or bending at the indentations 208*a*, 208*b* is orthogonal to the base 102 (e.g., in FIG. 1A, the chimney holding the bulb 101 is orthogonal to the base 102). Folding or bending at the indentations 204*a*, 204*b* facilitates keeping the chimney orthogonal to the base 102. In FIGS. 2 and 3, the hinge 202*a*, 202*b* is provided along the holder 103 at a different direction than the one or more indentations 204*a*, 204*b*, 208*a*, 208*b*. As such, the hinge 202*a*, 202*b* facilitates folding the holder 103 only along one direction while the one or more indentations 204*a*, 204*b*, 208*a*, 208*b* facilitate folding the holder 103 in a direction different from the one direction. For example, the second type of indentations 208*a*, 208*b* facilitate folding along a direction that is substantially orthogonal to the direction of folding by the hinge 202*a*, 202*b*.

In some implementations, some of the indentations 204*a*, 204*b*, 208*a*, 208*b* are perforated to facilitate extreme bends and conforming the elevated section 104 to items being held by the holder 103. Some of the multiple sections 206*a*, 206*b*, 210*a*, 210*b* can be separated from one another at the perforations.

The one or more indentations 204*a*, 204*b*, 208*a*, 208*b* are merely provided as examples of ways to enable bending of a rigid material. In some implementations, the material of the elevated section 104 is flexible and bendable, such that a lower number of indentations 204*a*, 204*b*, 208*a*, 208*b* or no indentations are provided. As long as the material is flexible enough to conform the elevated section 104 into a chimney to hold the item (e.g., the chimney holding the bulb 101 in FIG. 1A), a smaller number of or no indentations can be provided on the material. Similarly, a material that is very rigid may require a larger number of indentations 204*a*, 204*b*, 208*a*, 208*b* or the same number of indentations 204*a*, 204*b*, 208*a*, 208*b* as those provided in FIGS. 2 and 3.

In some implementations, the supporting post 106 is attached to the keeper 114 as shown in FIGS. 2 and 3. The supporting post 106 can include one or more flaps 216, a head 222 and a stem with a first part 218 and a second part 220. The one or more flaps 216 can attach to the keeper 114 to provide additional attachment points between the supporting post 106 and the keeper 114. The additional attachment points can help improve structural stability of the attachment of the supporting post 106 to the keeper 114. In some implementations, the attachment points between the one or more flaps 216 and the keeper 114 is perforated such that one or more of the flaps 216 can be detached from the keeper 114. Being able to detach the flaps can increase flexibility along the interface where the keeper 114 is connected to the supporting post 106.

The first part 218 of the stem of the supporting post 106 can attach to the keeper 114 at an interface that is malleable such that the supporting post 106 and the keeper 114 can be configured in different angles to each other. The first part 218 of the stem can have a cross-sectional area that changes over the length of the stem. In some implementations, the cross-sectional area of the first part 218 is smallest closer to the keeper 114 and largest closer to the head 222. In some implementations, the change in cross-sectional area manifests as the first part 218 of the stem having a smaller diameter at one end closer to the keeper 114, when compared to the opposite end closer to the head 222.

The second part 220 of the stem of the supporting post 106 can have a constant cross-sectional area, smaller than the largest cross-sectional area of the first part 218 of the stem. In some implementations, the second part 220 of the stem has a similar cross section to the one end of the first part 218 of the stem connected to the keeper 114. The second part 220 of the stem is configured to be received at the base 102. The smaller cross-sectional area of the second part 220 of the base is able to fit at least one of the openings or notches 108-X of the latch provided in the base 102. The head 222 can be shaped as a button, having a larger cross-sectional area than the second part 220 of the base. In some implementations, the head 222 has a larger cross-sectional area than the end of the first part 218 of the stem that attaches to the second part 220 of the stem. The head 222 prevents the supporting post 106 from moving in a vertical direction when the supporting post 106 engages with any of the notches 108-X provided in the latch.

FIG. 5 illustrates a perspective view of the latch with individual notches 108-1, 108-2, 108-3, etc., according to some implementations of the present disclosure. In some implementations, each of the individual notches 108-1, 108-2, 108-3 is situated above a vertical wall (e.g., vertical wall 504-1) with a wall height 502-1, 502-2, and 502-3, respectively. In some implementations, the vertical wall 504-1 is U-shaped as depicted in FIG. 5. Other shapes can be used for the vertical wall 504-1 based on the shape of the head 222 of the supporting post 106. The wall height 502-1 is greater than the wall height 502-2, which is greater than the wall height 502-3. The wall heights 502-1, 502-2, and 502-3 dictate a position of the supporting post 106 in relation to the top base surface 102*a* (FIG. 1) when the supporting post 106 is secured to at least one of the individual notches 108-1, 108-2, 108-3.

In some implementations, the individual notches 108-1, 108-2, 108-3 have a "keyhole" shape, as depicted in FIG. 5. The keyhole shape can be patterned on a horizontal piece 506-1. A keyhole shape can have a radial portion 508 along with two linear portions 510. The two linear portions 510 are not parallel to one another, in order to facilitate sliding the second part 220 of the stem into the radial portion 508 of the keyhole shape. Once the second part 220 of the stem is within the radial portion of the keyhole shape, the transitions between the radial portion and the linear portions serve as a latch that prevents the second part 220 of the stem from sliding out of the radial portion 508 of the notch (e.g., the notch 108-1). The second part 220 of the stem can snap-fit into the radial portion 508 of the keyhole shape such that the transitions between the radial portion 508 and the linear portions 510 provide a resistance that prevents the second part of the stem from sliding out of the notch (e.g., the notch 108-1).

Figure 6:
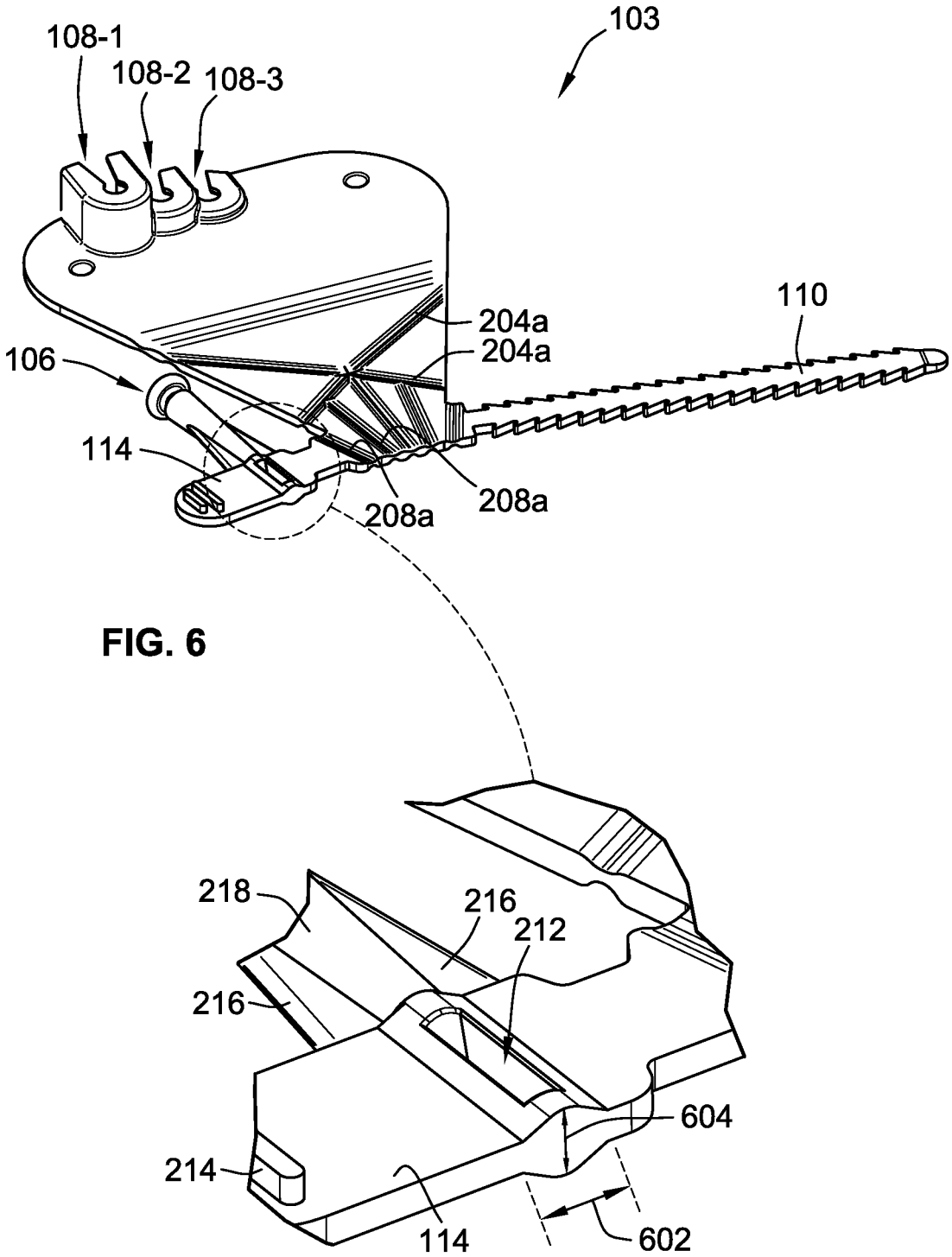
FIG. 6 illustrates a perspective view of a keeper on the holder of FIG. 2, according to some implementations of the present disclosure.

FIG. 6 illustrates a perspective view of a portion of the keeper 114 on the holder 103. FIG. 6 shows a closer view of the spacing 212 or opening. In some implementations, a portion 602 of the keeper 114 where the spacing 212 is located can have a thickness 604 which is thicker than the thickness of other portions of the keeper 114. The thickness 604 can be variable over the portion 602 of the keeper 114. In some implementations, a curvature defining the variable thickness can match a curvature of the first part 218 of the stem of the supporting post 106.

In some implementations, the holder 103 illustrated in FIGS. 1A and 1B-6 can be manufactured using a single, unitary substrate (e.g., a polypropylene substrate). In some implementations, the single substrate is molded to provide the holder 103 in the unassembled configuration of FIGS. 2 to 4. The hinge 202*a*, 202*b* can be provided by machining scores, creases, or removing some of the material of the substrate so that areas around the top hinge surface 202*a*, the bottom hinge surface 202*b*, or both the top hinge surface 202*a* and the bottom hinge surface 202*b* have a smaller thickness as depicted in FIG. 4. Removal of the material around the hinge 202*a*, 202*b* can leave the top hinge surface 202*a*, the bottom hinge surface 202*b*, or both the top hinge surface 202*a* and the bottom hinge surface 202*b* with a "v" shaped indent.

Similar to the hinge 202*a*, 202*b*, the one or more indentations 204*a*, 204*b*, 208*a*, 208*b* can be realized as well with scores, creases, or material removal at the specified locations. The scores provided at the one or more indentations 204*a*, 204*b*, 208*a*, 208*b* creates weak points in the molded single substrate such that the molded substrate is bendable or foldable at these weak points. The scores representing the one or more indentations 204*a*, 204*b*, 208*a*, 208*b* can also be "v" shaped.

In some implementations, providing scores or creases on the top surface "a" (see FIG. 2) and the bottom surface "b" (see FIG. 3) facilitates folding the molded substrate along the different creases towards either the top surface "a" or the bottom surface "b". For example, in order to create the chimney to hold the bulb in FIG. 1A, the top surface of the multiple sections 210*a* of FIG. 2 folds inwards (i.e., the angle between adjacent sections of the multiple sections 210*a* is reduced from 180 degrees along the indentations 208*a*). Since the top surface of the multiple sections 210*a* fold inwards, the bottom surface of the multiple sections 210*b* (FIG. 3) folds outwards such that an angle between adjacent sections of the multiple sections 210*b* is around 180 degrees or greater than 180 degrees. The multiple sections 210*a*, 210*b* thus form a chimney for holding the bulb 101 as shown in FIGS. 1A and 1B due to the folding along the indentations 208*a*, 208*b*. In other words, the folding movements of the various sections or portions defined by the scores resemble an origami-inspired fold, creating numerous intersecting and parallel planes when the folding actions transform the holder 103 from a unassembled configuration into an assembled configuration, such as three, or four, or five, or six distinct planes taken across each section formed by the folding actions (see, e.g., FIG. 9B).

In order to hold the chimney at a 90-degree or other fixed angle relative to the base 102 (as shown in FIGS. 1A and 1B), the scores provided at the indentations 204*a*, 204*b* (as shown in FIGS. 2 and 3) facilitate bending in directions opposite to the bending of the indentations 208*a*, 208*b*. The indentations 204*a*, 204*b* facilitate bending the top surface of adjacent sections of the multiple sections 206*a* away from each other and the bottom surface of adjacent sections of the multiple sections 206*b* toward each other. As such, the top surface of the multiple sections 206*a* bend away from each other, having an angle larger than 180 degrees between adjacent sections of the multiple sections 206*a*. The bottom surface of the multiple sections 206*b* bend toward each other, having an angle smaller than 180 degrees between adjacent sections of the multiple sections 206*b*. Thus, the indentations 208*a*, 208*b* facilitate folding toward the "a" surface and away from the "b" surface to create the chimney, and the indentations 204*a*, 204*b* facilitate folding toward the "b" surface and away from the "a" surface to hold the chimney substantially orthogonal to the base 102.

Figure 7A:
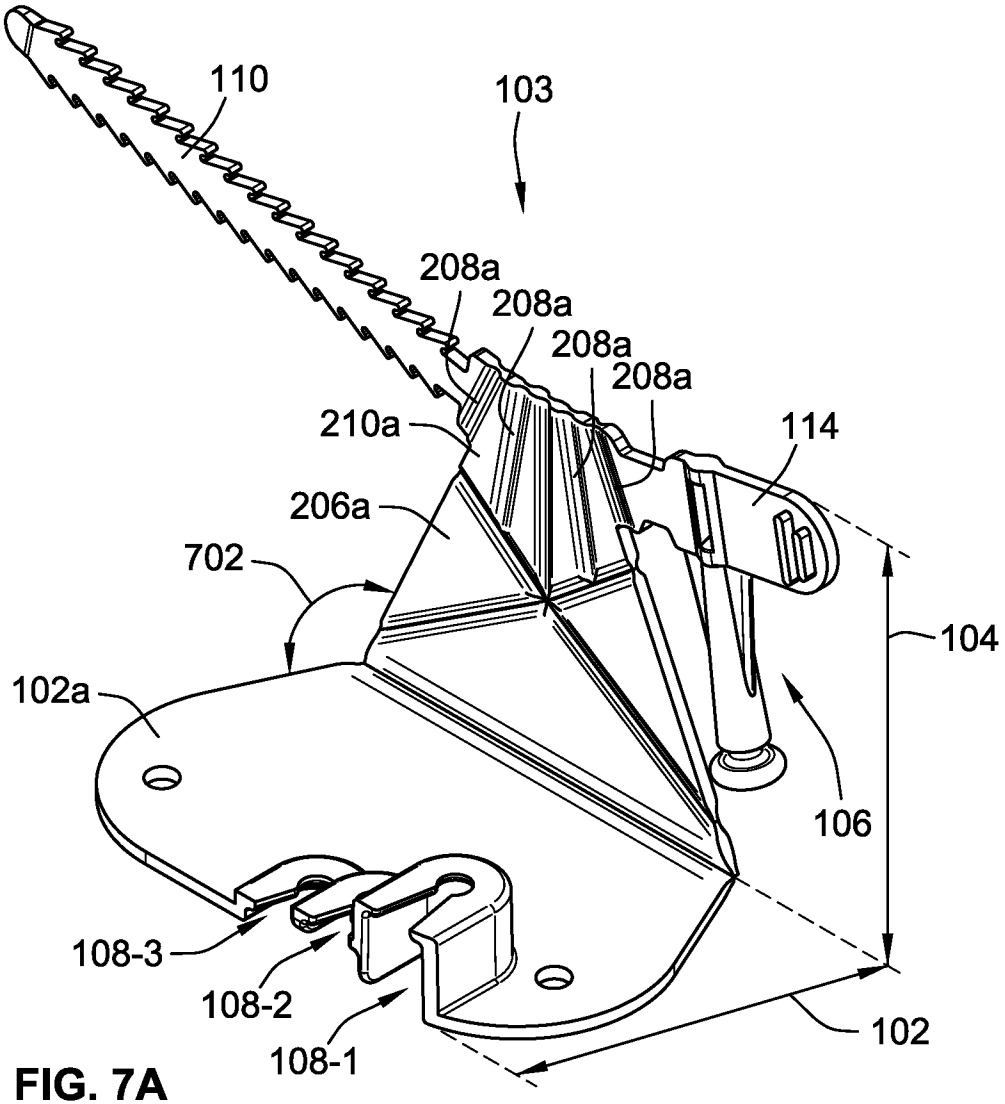
FIG. 7A illustrates a perspective view of the holder of FIG. 2 folded at a hinge of the holder, according to some implementations of the present disclosure.

FIGS. 7A-7D illustrate different perspective views of intermediate configurations in transforming the holder 103 from the unassembled configuration of FIGS. 2-4 to the assembled configuration of FIGS. 1A and 1B. In a first step of transforming the holder 103 from the unassembled configuration to the assembled configuration, the hinge 202*a*, 202*b* is folded such that the elevated section 104 is no longer coplanar with the base 102. FIG. 7A illustrates a perspective view of the holder 103 folded at the hinge 202*a*, 202*b*, according to some implementations of the present disclosure. Compared to FIG. 2, in FIG. 7A, the elevated section 104 is at an angle 702 (less than 180 degrees) from the base 102.

Figure 7B:
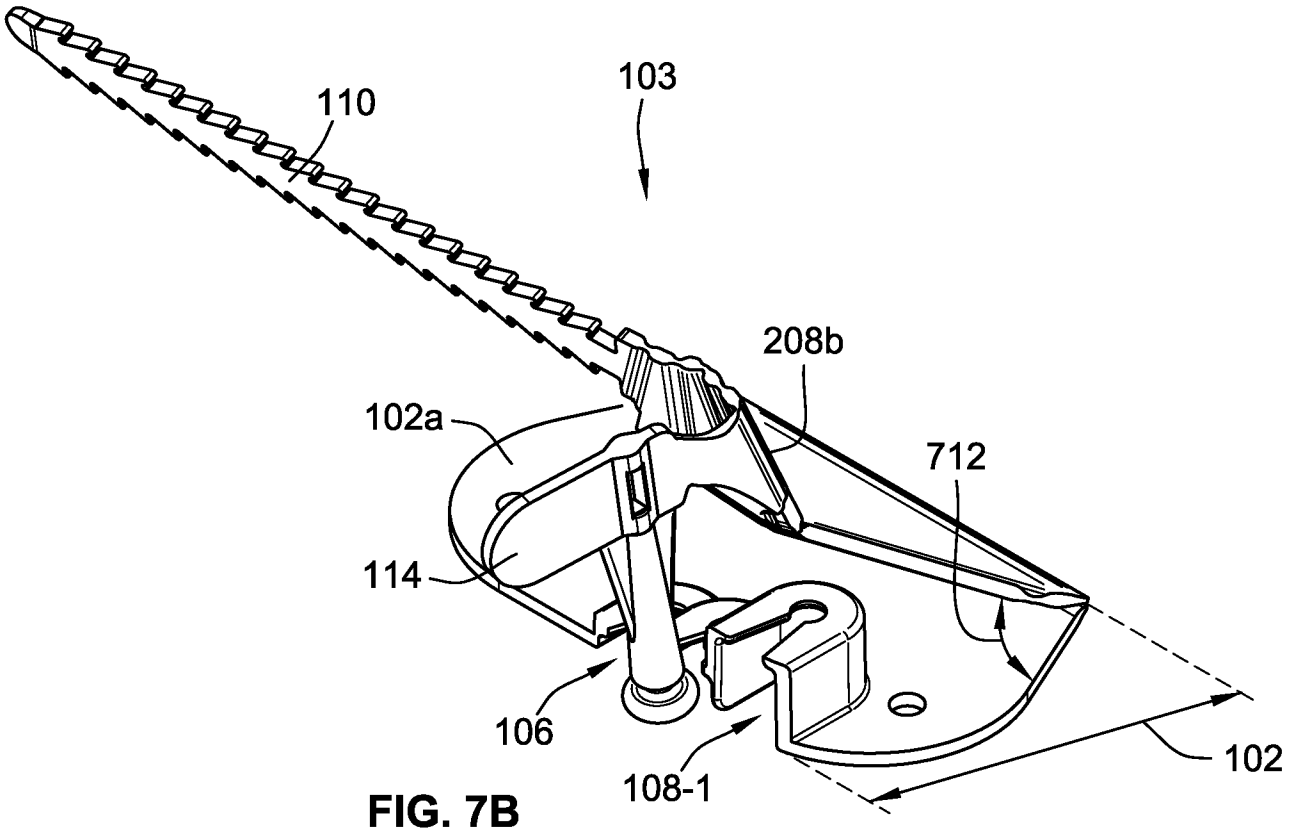
FIG. 7B illustrates a perspective view of the holder of FIG. 7A folded at an indentation such that the keeper of the holder is no longer coplanar with a strip of the holder, according to some implementations of the present disclosure.

In a second step, the elevated section 104 is folded and shaped to move the supporting post 106 toward the notches 108-X of the latch. In some implementations, the elevated section 104 is folded at the one or more indentations (e.g., the second type of indentations 208*a*, 208*b*) such that the strip 110 is no longer coplanar with the keeper 114. FIG. 7B illustrates a perspective view where the keeper 114 and the strip 110 are no longer coplanar, according to some implementations of the present disclosure. Furthermore, in some implementations, when swinging the supporting post 106 along with the keeper 114, in order to clear the notch 108-1 provided at the base 102, the elevated section 104 can be bent forward even more such that an angle 712 between the elevated section 104 and the base 102 is less than the angle 702.

Figure 7C:
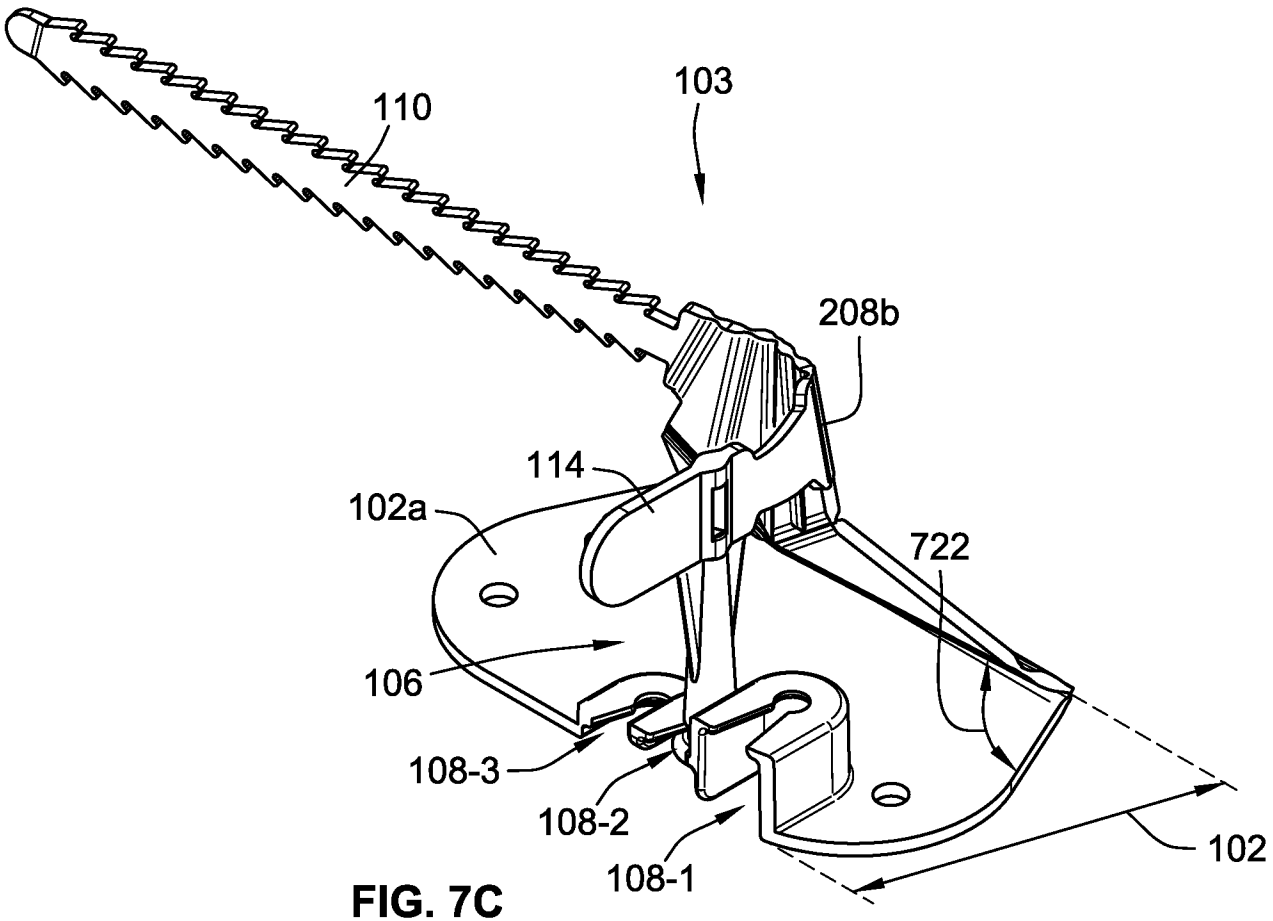
FIG. 7C illustrates a front perspective view of the holder of FIG. 7A with a supporting post of the holder engaging the latch of the holder, according to some implementations of the present disclosure.
Figure 7D:
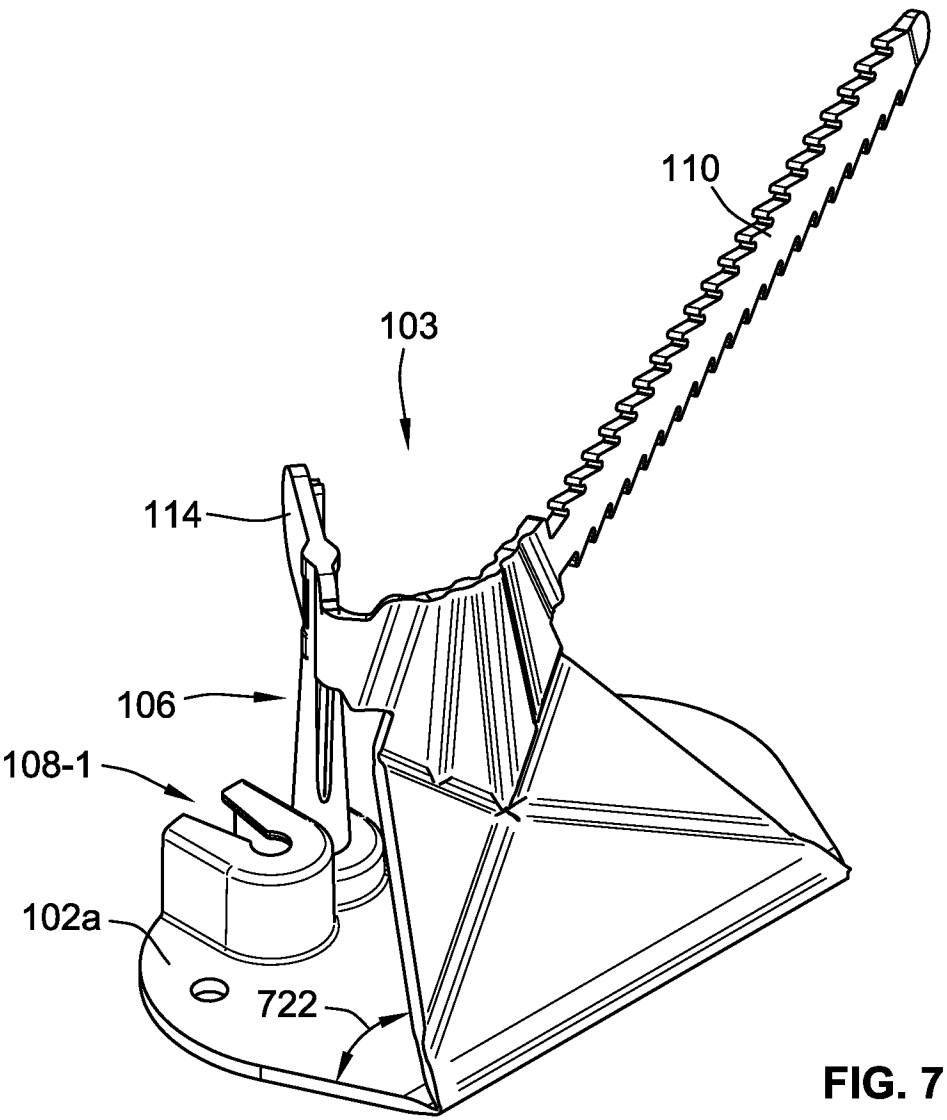
FIG. 7D illustrates a back perspective view of the holder of FIG. 7C.

In a third step, the supporting post 106 engages with one of the notches 108-X and is secured therein. For example, FIG. 7C illustrates a front perspective view of the holder 103 with the supporting post 106 secured in the notch 108-2. FIG. 7D illustrates a back perspective view of the holder 103 of FIG. 7C. As shown in FIGS. 7C and 7D, the shape of the elevated section 104 conforms such that the elevated section 104 flexibly accommodates securing the supporting post 106 in the notch 108-1. The first type of indentations 204*a*, 204*b* and the second type of indentations 208*a*, 208*b* facilitate the flexible shaping of the elevated section 104 as discussed above. Furthermore, when the supporting post 106 is secured to the notch 108-1, an angle 722 between the elevated section 104 and the base 102 is greater than the angle 712 but less than the angle 702.

Figure 7E:
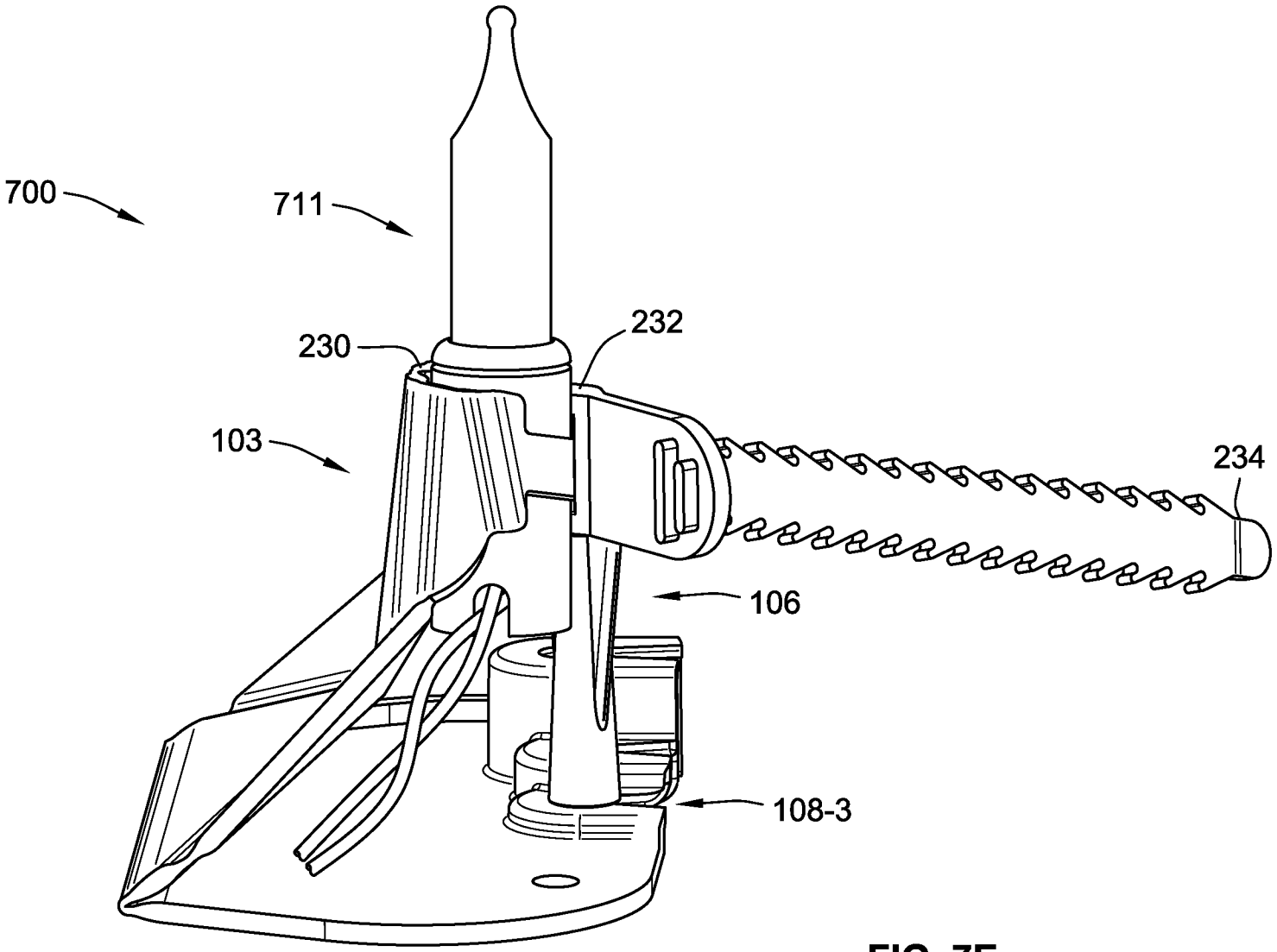
FIG. 7E illustrates a perspective view of a bulb in the holder of FIG. 7A, according to some implementations of the present disclosure.
Figure 7F:
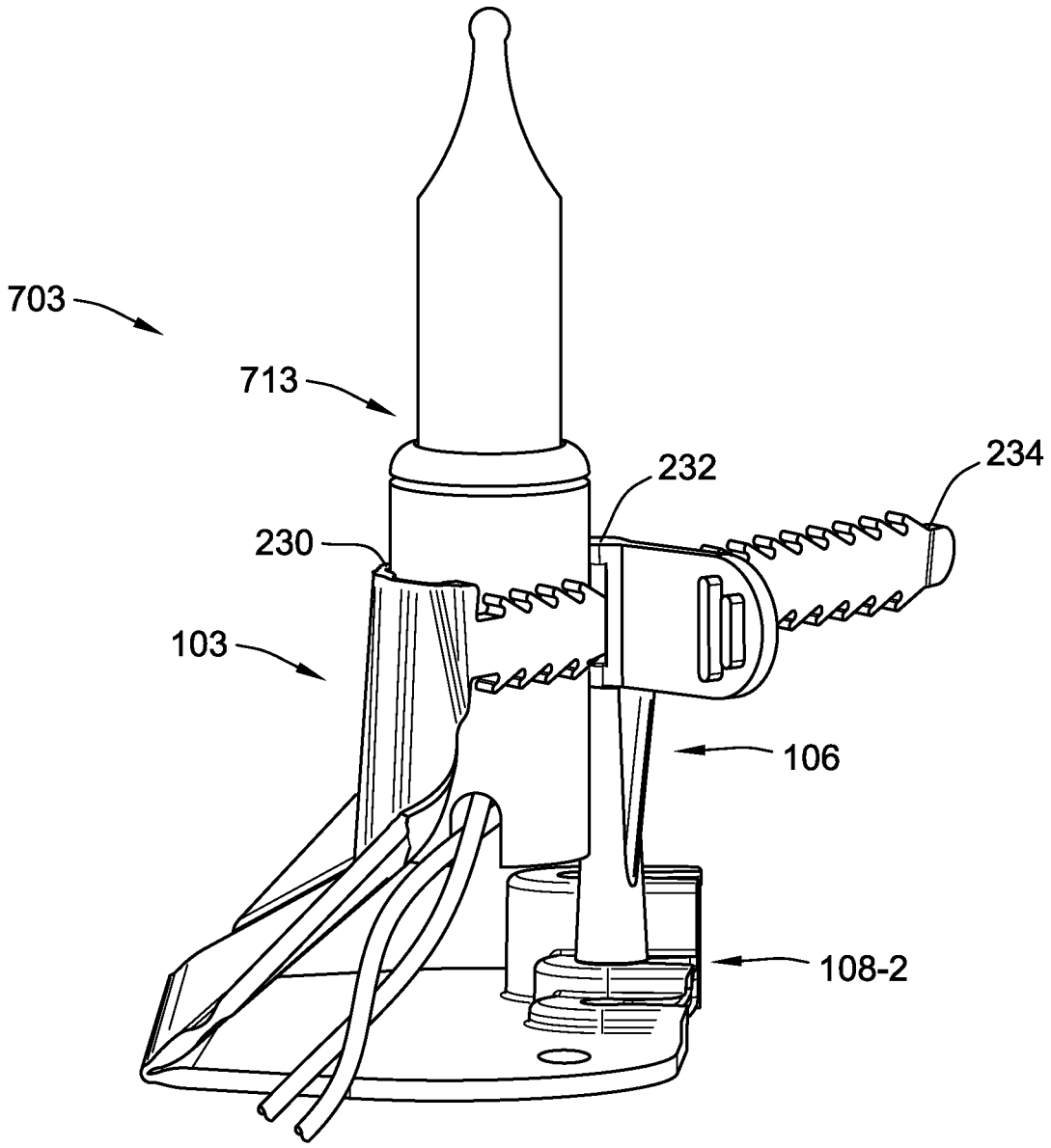
FIG. 7F illustrates a perspective view of a bulb in the holder of FIG. 7A, according to some implementations of the present disclosure.
Figure 7G:
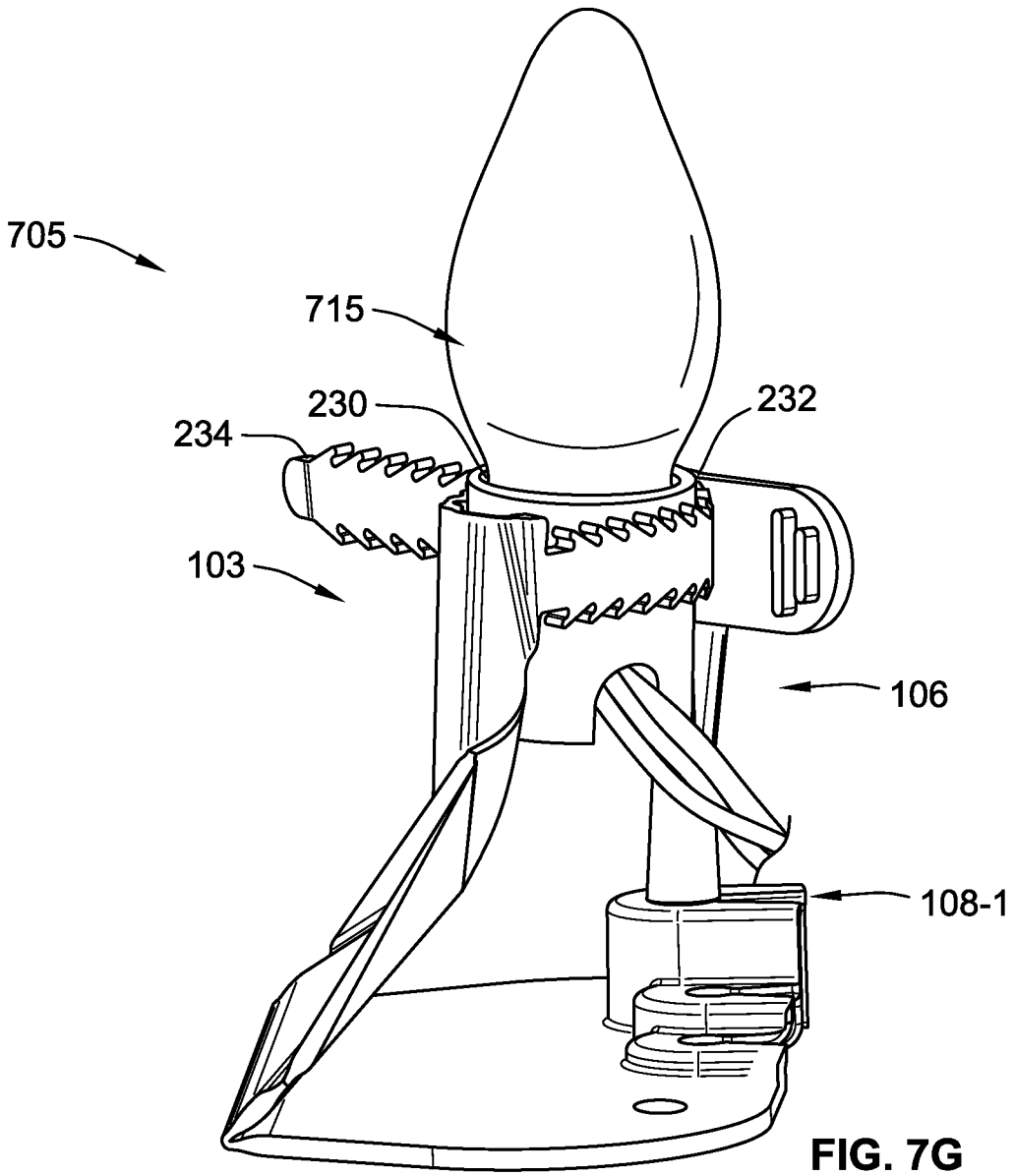
FIG. 7G illustrates a perspective view of a bulb in the holder of FIG. 7A, according to some implementations of the present disclosure.

In a fourth step, a free end of the strip 110 is threaded through the spacing 212 in the keeper 114 until a chimney formed by the keeper 114, the strip 110, and the multiple sections 210*a* completely surrounds an item to be held. FIGS. 7E-7G illustrate different sized bulbs being held together by different sized chimneys. FIG. 7E illustrates a bulb-holder combination 700 with a smaller-sized bulb 711 in the holder 103. The holder 103 is configured such that the supporting post 106 is positioned in the notch 108-3. FIG. 7F illustrates a bulb-holder combination 703 with an intermediate-sized bulb 713 in the holder 103. The holder 103 is configured such that the supporting post 106 is positioned in the notch 108-2. FIG. 7G illustrates a bulb-holder combination 705 with a larger-sized bulb 715 in the holder 103. The holder 103 is configured such that the supporting post 106 is positioned in the notch 108-1. To free a bulb from the holder 103, the above steps can be reversed.

FIGS. 7E, 7F, and 7G illustrate the holder 103 securing three different sized bulbs, a small-sized bulb, a medium-sized bulb, and a large-sized bulb. Latching the supporting post 106 in the notch 108-1 provides a curvature for the fastener (the strip 110 and the keeper 114) to properly fit the large-sized bulb. As such, in some implementations, the notch 108-1 can be labeled LARGE and provided to secure objects with the largest diameters. Latching the supporting post 106 in the notch 108-3 provides a curvature for the fastener (the strip 110 and the keeper 114) to properly fit the small-sized bulb. Similarly, in some implementations, the notch 108-3 can be labeled SMALL or "S" or the like (e.g., as appropriate in a non-English language) and provided to secure objects with the smallest diameters. The notch 108-2 can be labeled MEDIUM, "M", or the like and provided to secure objects with diameters between the large-sized bulb and the small-sized bulb. In some implementations, this is a trial and error process to find the best fit for a light bulb. The supporting post 106 can be placed in any one of the notches labeled as LARGE (or "L"), MEDIUM, or SMALL to gauge a fit for the light bulb prior to securing the light bulb in the holder 103.

In each of FIGS. 7E, 7F, and 7G, in the assembled configuration, the portion 234 of the strip 110 and the portion 232 of the keeper 114 no longer extend above the upper edge 230 of the holder 103. Also in each of FIGS. 7E, 7F, and 7G, changing a diameter of the chimney to accommodate the different sized bulbs does not affect the holder 103 having the upper edge 230 being a highest point of the holder 103. By being able to move the supporting post 106 both laterally and vertically along the base 102 of the holder 103 and having the elevated section 104 be flexible to accommodate different-sized chimney diameters, the major axes of the keeper 114 and the strip 110 can be engineered to be parallel to the base 102. As such, even though the keeper 114 and the strip 110 extend above the upper edge 230 in the unassembled position as depicted in FIGS. 2 and 3, when in the assembled position, the upper edge 230 is the highest point for the holder 103.

Figure 8:
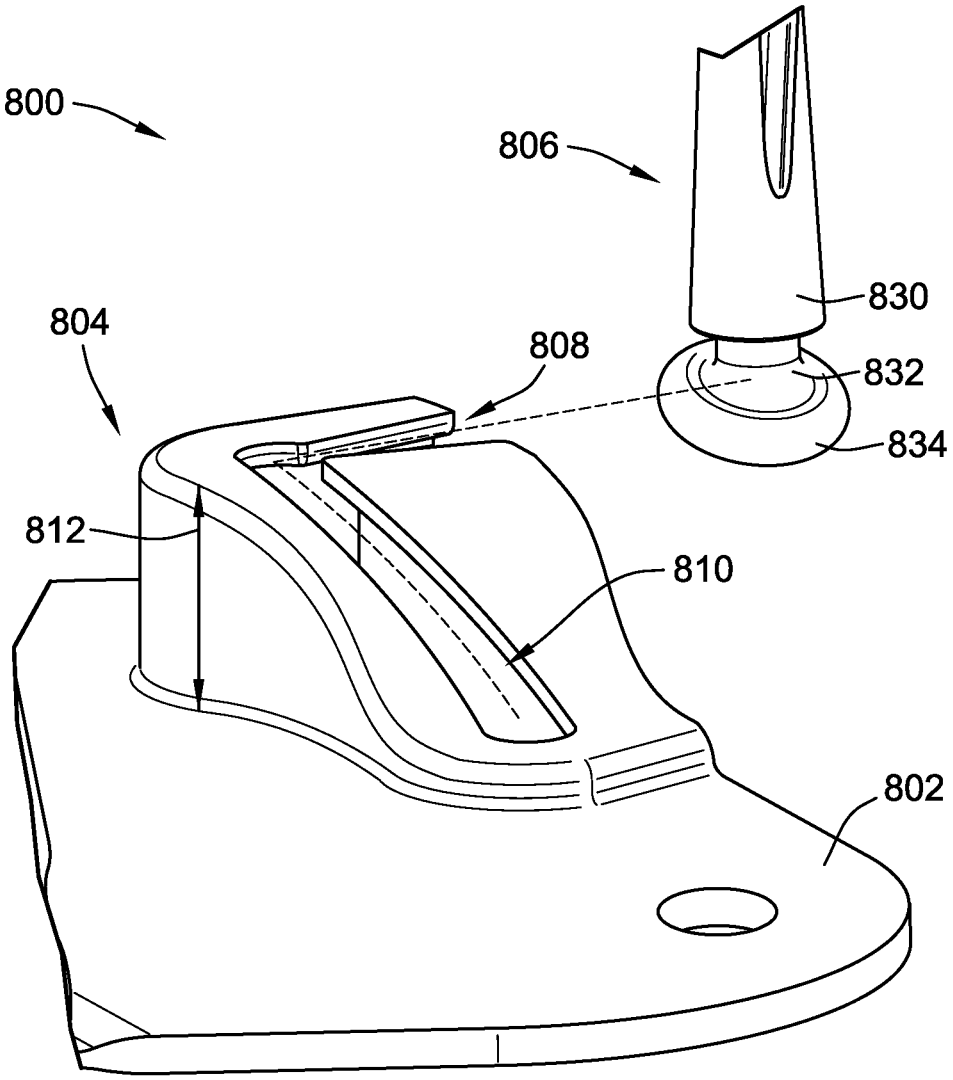
FIG. 8 illustrates an adjustable latch for a holder, according to some implementations of the present disclosure.

In some implementations, a height where the supporting post 106 is secured on the latch can be more continuous. For example, FIG. 8 illustrates an alternative design 800 with an adjustable latch 804 for a holder along with a supporting post 806, according to some implementations of the present disclosure. A base 802 of the holder includes the adjustable latch 804 with an input slot 808 for receiving the supporting post 806. The input slot 808 leads to a channel 810. The supporting post 806 can be positioned along any position on the channel. The positions on the channel have a varying height 812 from the top surface of the base 802. The supporting post 806 includes a head 834 and a stem. The stem has a first part 830 and a second part 832. The first part 830 of the stem in FIG. 8 is similar to or the same as the first part 218 of the stem in FIGS. 2 and 3. The head 834 is tilted or angled in relation to the first part 830 of the stem. The tilt of the head 834 facilitates the supporting post 806 sliding along the channel 810. The tilt of the head 834 also facilitates the supporting post 806 being received in the input slot 808.

Figure 9A:
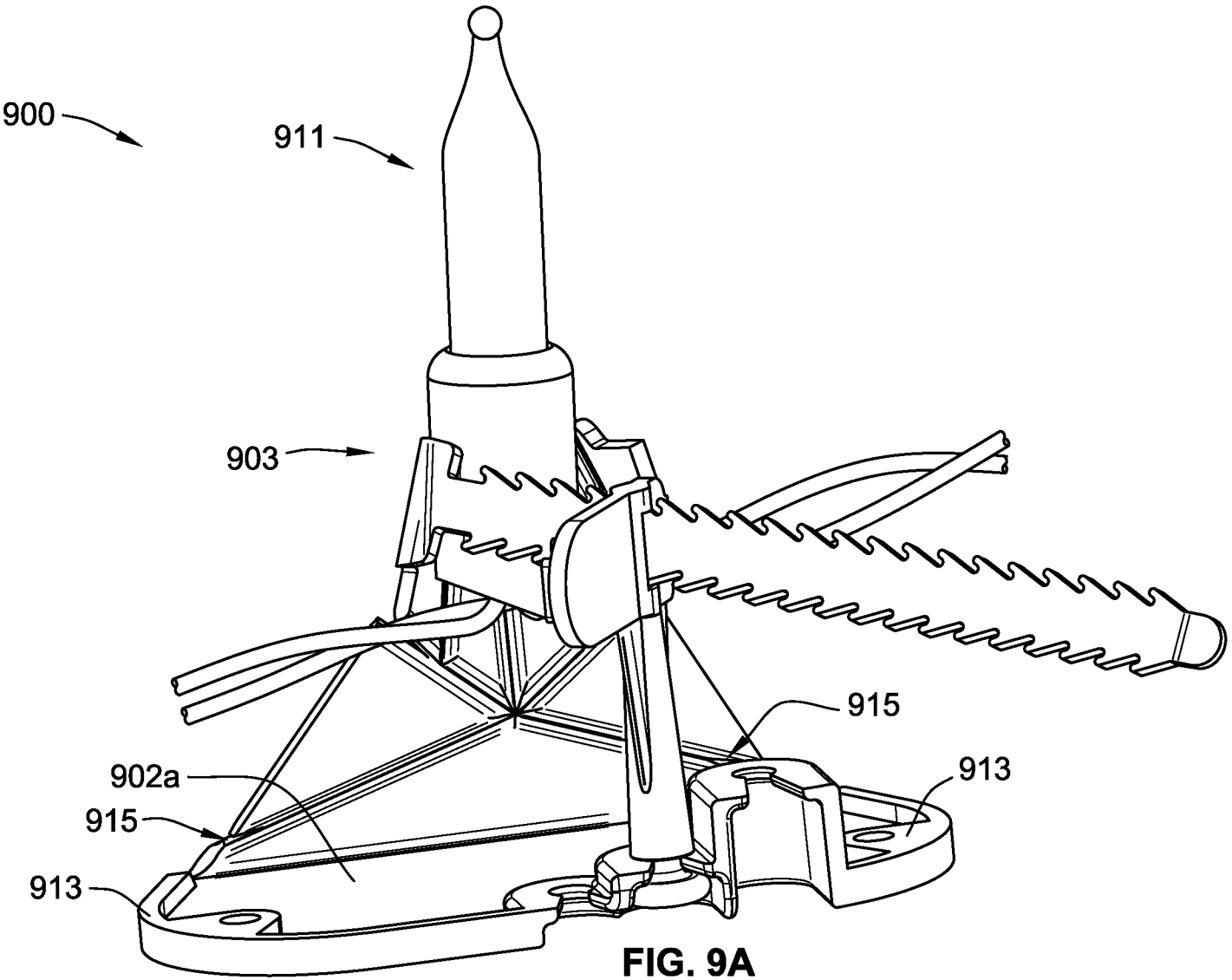
FIG. 9A illustrates a front perspective view of a bulb in a holder, according to some implementations of the present disclosure.
Figure 9B:
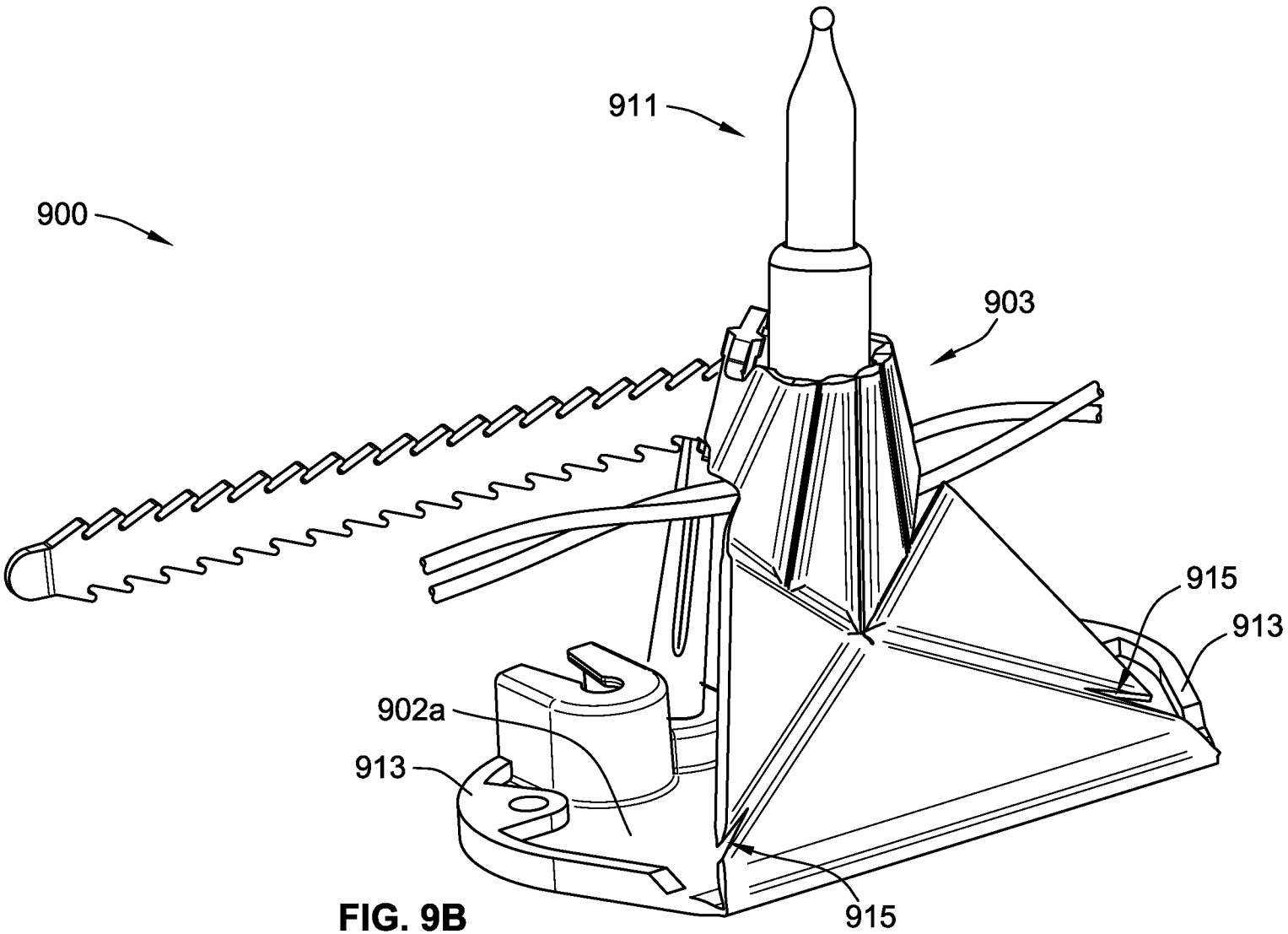
FIG. 9B illustrates a back perspective view of the bulb and the holder of FIG. 9A, according to some implementations of the present disclosure.

FIG. 9A illustrates a front perspective view of a bulb-holder combination 900, according to some implementations of the present disclosure. The bulb-holder combination 900 includes a bulb 911 secured by a holder 903. The holder 903 is similar to the holder 103 in FIG. 1A. The holder 903 can have several distinctions from the holder 103 of FIG. 1A. In some implementations, the holder 903 includes a top base surface 902*a* and embossed edges 913. In some implementations, the holder 903 has separations 915 to facilitate conforming the holder 903 to the shape of the bulb 911. The separations can be a result of prying apart perforations along indentations in the holder 903, as discussed above in connection to the one or more indentations 204*a*, 204*b*. FIG. 9B illustrates a back perspective view of the bulb 911 in the holder 911.

Figure 10:
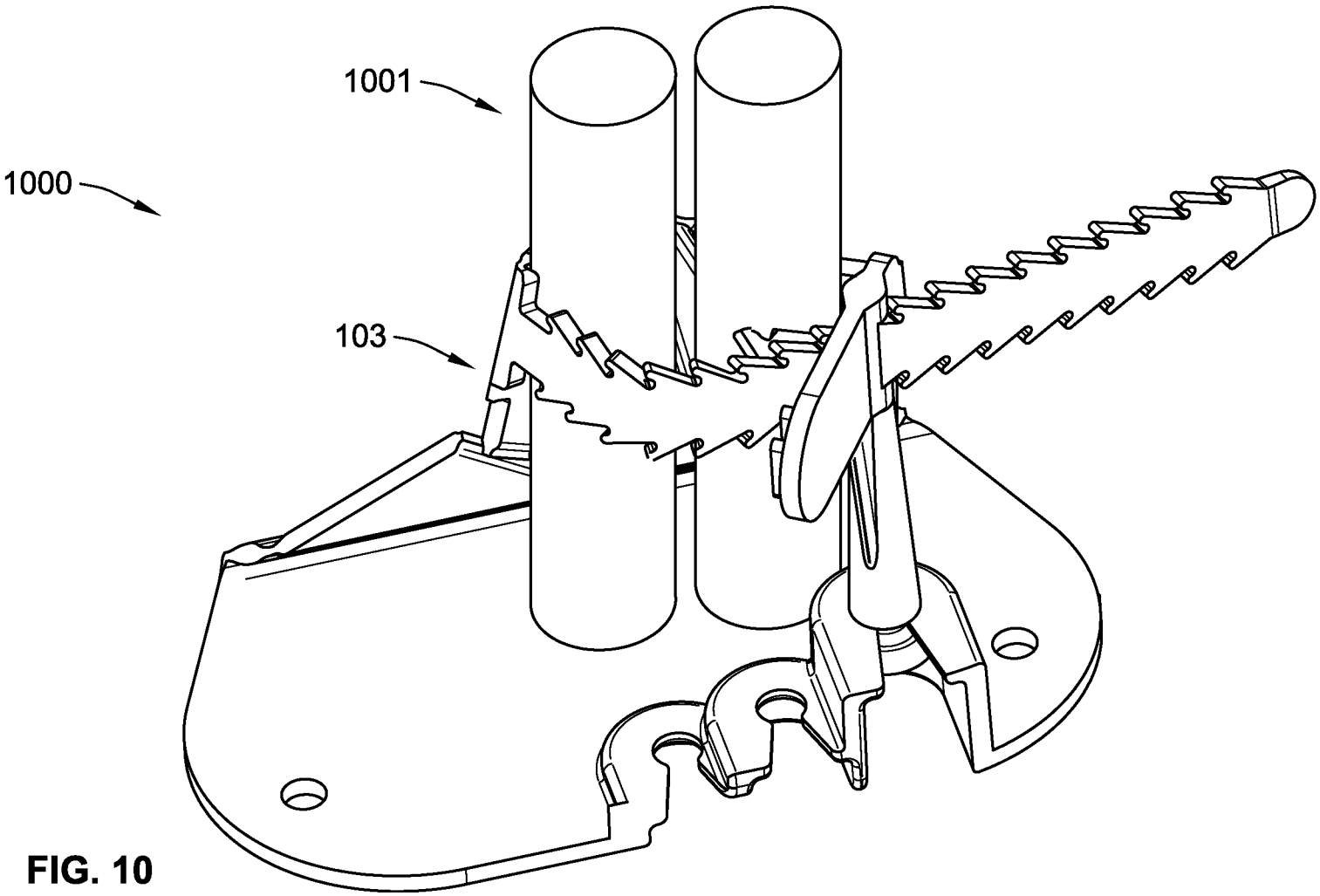
FIG. 10 illustrates a perspective view of cylindrical items in a holder, according to some implementations of the present disclosure.

Some implementations of the present disclosure can be used to hold other items apart from lights and light strings. For example, FIG. 10 illustrates a perspective view of a combination 1000 including cylindrical rods 1001 secured in the holder 103, according to some implementations of the present disclosure. The cylindrical rods 1001 can represent pens, markers, a larger diameter light bulb, etc. The holder 103 can thus be used as a work desk organizer. In FIG. 10, the chimney formed has a wider diameter than in FIG. 1A, and the supporting post 106 is locked in the highest notch, which keeps the items being held at a perpendicular orientation in relation to the base. Furthermore, the chimney having a wider diameter when the supporting post 106 is locked in the highest notch keeps the top of the chimney flat about its exposed circumference.

Figure 11A:
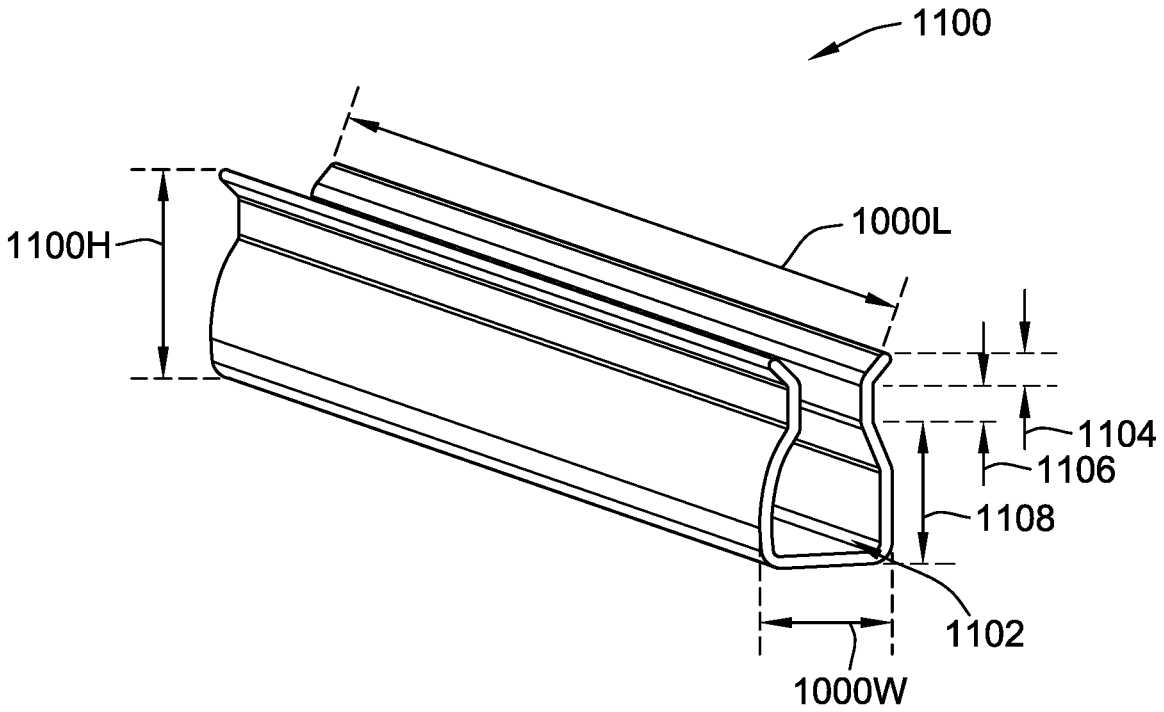
FIG. 11A illustrates a perspective view of a light stand, according to some implementations of the present disclosure.
Figure 11B:
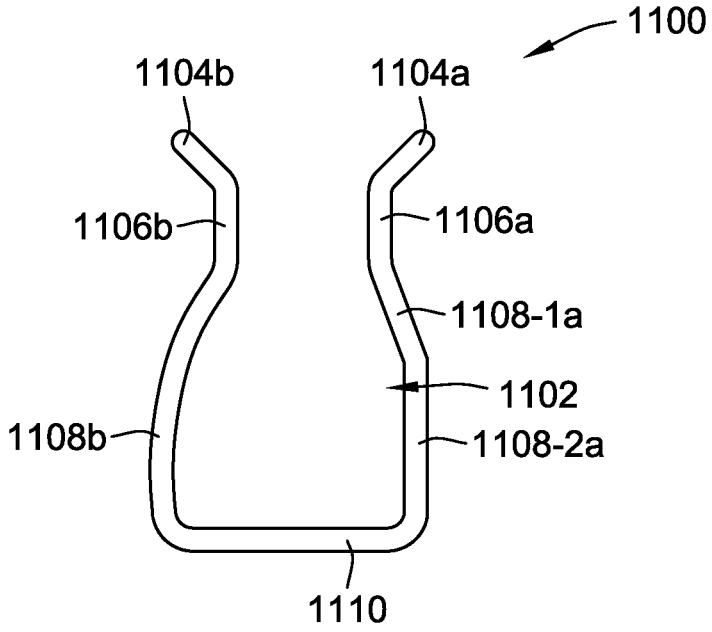
FIG. 11B illustrates a side plan view of the light stand of FIG. 11A.

FIG. 11A illustrates a perspective view of a light stand 1100, according to some implementations of the present disclosure. The light stand 1100 can position multiple bulbs of a decorative string of lights in upright positions. The light stand 1100 is also able to hide electrical wires of the decorative string of lights. The light stand 1100 has a width 1100*w*, a height 1100*h*, and a length 11001. In some implementations, the length 11001 of the light section is about 3 feet or about 4 feet. The height 1100*h* can be variable based on a height of light bulbs in the decorative string of lights, and the width 1100*w* can be dependent on a diameter of the light bulbs. In some implementations, the width 1100*w* is about 0.4 inches, and the height 1100*h* is about 0.6 inches. The light stand 1100 is shaped to form a channel 1102 where wires of the decorative string of lights can reside. FIG. 11B illustrates a side plan view of the light stand of FIG. 11A.

The light stand 1100 can be a single piece of material (e.g., metal, plastic, etc.) that is shaped as shown in FIG. 11A. The light stand 1100 can include a fanned-out section 1104 where sidewalls 1104*a* and 1104*b* (FIG. 11B) spread apart from each other in a funnel-shaped manner. The light stand 110 can include a section 1106 (FIG. 11A) with sidewalls 1106*a* and 1106*b* (FIG. 11B) that are parallel to each other. The light stand 110 can further include a section 1108 with irregularly shaped sidewalls 1108-1*a*, 1108-2*a*, and 1108*b*. The sidewalls 1108-1*a* and 1108-2*a* form a linear approximation of a non-flat (or curved) wall in the section 1108. The sidewall 1108*b* is a curved wall without the linear approximation. Due to one side of the light stand 1100 having a linear approximation of a curved wall and the other side of the light stand 1100 having a smooth, curved wall, the light stand 1100 does not have an axis of symmetric when bisected along the channel 1102 to separate the "a" side from the "b" side. The light stand 1100 can further include a flat base 1110.

In some implementations, part of the inner surface of the light stand 1100 can be coated with reflective material or the light stand 1100 can be made from reflective material as to amplify and/or direct light from the light bulbs of the decorative light sitting upright in the light stand 1100. The fanned-out section 1104 is shaped as such in order to allow light from the light bulbs to escape, and the sidewalls 1104*a* and 1104*b* can be reflective such that any light from the light bulbs hitting these sidewall surfaces is redirected outside the channel 1102. The section 1106 has a smaller separation between the sidewalls 1106*a* and 1106*b* compared to sidewall separation in the other sections 1104 and 1108. The smaller separation between the sidewalls 1106*a* and 1106*b* ensure that the bulbs are positioned upright in the light stand 1100. The section 1108 includes the non-flat walls to provide enough spacing for routing wires such that the wires are located in the channel 1102 between the sidewall 1108*b* and the sidewalls 1108-1*a* and 1108-2*a*.

While the present disclosure has been described with reference to one or more particular embodiments or implementations, those skilled in the art will recognize that many changes may be made thereto without departing from the spirit and scope of the present disclosure. Each of these implementations and obvious variations thereof is contemplated as falling within the spirit and scope of the present disclosure. It is also contemplated that additional implementations according to aspects of the present disclosure may combine any number of features from any of the implementations described herein.

What is claimed is:

1. A holder for setting a bulb in a specified orientation, comprising:

a supporting post;

a base including a latch for receiving the supporting post;

a flexible portion;

a fastener attached to the flexible portion, the fastener including a strip and a keeper, wherein the strip and the keeper are positioned on opposite sides of the flexible portion, and the keeper is configured to engage the strip and hold the strip in place, and wherein the strip includes a series of teeth for engaging a spacing in the keeper, such that when the keeper receives the strip, the series of teeth prevent the strip from disengaging from the keeper; and a first hinge positioned between the base and the flexible portion, wherein the flexible portion is configured to pivot at the first hinge between (i) a first position where the flexible portion and the base are coplanar and (ii) a second position where the flexible portion and the base are not coplanar and the supporting post is received in the latch.

2. The holder according to claim 1, wherein when the strip and the keeper are disengaged, a major axis of the strip and a major axis of the keeper are at an angle such that portions of the strip and the keeper extend above an upper edge of the flexible portion.

3. The holder according to claim 2, wherein when the strip and the keeper are engaged, the portions of the strip and the keeper do not extend above the upper edge of the flexible portion.

4. The holder according to claim 1, wherein the supporting post is attached to the keeper.

5. The holder according to claim 4, wherein when the flexible portion is configured in the second position, the supporting post is positioned in a direction orthogonal to the base.

6. The holder according to claim 4, wherein an interface where the supporting post is attached to the keeper is malleable such that the supporting post and the keeper can be configured in different angles to each other.

7. The holder according to claim 1, wherein the keeper includes bumps that facilitate engaging the keeper to the strip.

8. The holder according to claim 1, wherein the flexible portion further includes:

one or more indentations dividing the flexible portion into multiple flat sections, wherein the flexible portion folds at the one or more indentations to partially conform a shape of the flexible portion to a shape of the bulb.

9. The holder according to claim 8, wherein a subset of the one or more indentations are perforated such that a subset of the multiple flat sections can partially separate from each other.

10. The holder according to claim 1, wherein the bulb is set upright in an orientation orthogonal to the base when the flexible portion is configured in the second position.

11. The holder according to claim 1, wherein the base further includes holes for mounting the holder to a surface.

12. The holder according to claim 1, wherein the latch of the base includes:

at least one slot in the base configured to receive a portion of the supporting post, interlocking the supporting post with a body of the base.

13. A holder, comprising:

a base portion having a slot;

a top portion;

an intermediate portion between the base portion and the top portion and having multiple folding sections to form a support for the top portion;

a strap portion extending from the top portion and having a free end, wherein an opening formed by closing the strap portion is adjustable to create a chimney for receiving a bulb; and a post extending from the top portion and configured to lock into the slot to form an opening between the base and top portion, wherein the post locks into the base portion at different heights.

14. A holder, comprising:

a base portion;

a top portion;

an intermediate portion between the base portion and the top portion and having a score or crease between the intermediate portion and the base portion;

an elongated strap portion having a free end and extending from the top portion along an angle that deviates from the score or crease by about 20 degrees, wherein an opening formed by closing the elongated strap portion is adjustable to create a chimney for receiving a bulb; and a post extending from the top portion and configured to lock into a slot of the base portion to form an opening between the base and top portion, wherein the post locks into the base portion at different heights.

15. The holder of claim 14, wherein the chimney has a flat top and is approximately orthogonal to the base portion, the chimney being configurable to accommodate diameters between about 2.4 mm to about 7 mm.

* * * * *